US008261513B2

(12) United States Patent
Irwin

(10) Patent No.: US 8,261,513 B2
(45) Date of Patent: Sep. 11, 2012

(54) APPARATUS AND METHOD FOR SEVERING AND LOADING BAG FASTENERS

(76) Inventor: Jere F. Irwin, Yakima, WA (US)

( * ) Notice: Subject to any disclaimer, the term of this patent is extended or adjusted under 35 U.S.C. 154(b) by 239 days.

(21) Appl. No.: 12/572,129

(22) Filed: Oct. 1, 2009

(65) Prior Publication Data

US 2011/0079123 A1 Apr. 7, 2011

Related U.S. Application Data

(63) Continuation of application No. 11/265,430, filed on Nov. 1, 2005, now Pat. No. 7,596,928.

(60) Provisional application No. 60/624,672, filed on Nov. 2, 2004.

(51) Int. Cl.
*B65B 51/04* (2006.01)

(52) U.S. Cl. ..... 53/417; 53/138.2; 53/76

(58) Field of Classification Search ..... 53/416, 53/417, 138.1, 138.2, 138.3, 76; 83/628
See application file for complete search history.

(56) References Cited

U.S. PATENT DOCUMENTS

| | | | | |
|---|---|---|---|---|
| 529,639 | A | 11/1894 | Autrey | |
| 767,123 | A | 8/1904 | Nicholls | |
| 796,389 | A | 8/1905 | Wright | |
| 806,037 | A | 11/1905 | Wilcox | |
| 994,119 | A | 6/1911 | Browning | |
| 1,499,673 | A | 7/1924 | Lobl | |
| 1,721,415 | A | 7/1929 | Schnefel | |
| 2,799,923 | A | 7/1957 | Senshu | |
| 2,890,706 | A | 6/1959 | Guardino | |
| 2,995,820 | A | 8/1961 | Pocoski | |
| 3,099,116 | A * | 7/1963 | Platt, Jr. et al. | 53/138.3 |
| 3,163,969 | A | 1/1965 | Irwin et al. | |
| 3,163,972 | A * | 1/1965 | Irwin | 53/138.3 |
| 3,188,737 | A | 6/1965 | Chase | |
| 3,315,354 | A | 4/1967 | Oates, Jr. | |
| 3,370,396 | A * | 2/1968 | Paxton et al. | 53/138.3 |
| 3,583,131 | A * | 6/1971 | Gaudlitz | 53/138.3 |
| 3,762,253 | A | 10/1973 | Loomis et al. | |
| 3,943,948 | A | 3/1976 | Sartore | |
| 3,983,681 | A * | 10/1976 | Britt et al. | 53/76 |
| 3,997,966 | A | 12/1976 | Sartore | |
| 4,117,591 | A | 10/1978 | Terry | |

(Continued)

FOREIGN PATENT DOCUMENTS

EP 05819572 7/2009

(Continued)

OTHER PUBLICATIONS

PCT/US05/039680 IPRP, May 8, 2007, Irwin.

(Continued)

*Primary Examiner* — Paul R Durand
(74) *Attorney, Agent, or Firm* — Wells St. John P.S.

(57) ABSTRACT

A clip-separating machine is provided with a guide frame, a clipper, and a displacement structure. The guide frame is configured to support a strip of clips. The clipper has a pair of opposed cutting edges. One of the edges is supported for movement toward and away from another of the edges. The displacement structure is configured to move the one cutting edge toward the other cutting edge so as to cause co-action of the cutting edges to sever a terminal clip from a strip of clips. A method is also provided.

16 Claims, 26 Drawing Sheets

U.S. PATENT DOCUMENTS

| | | | | | |
|---|---|---|---|---|---|
| 4,176,449 | A | | 12/1979 | Lee et al. | |
| RE30,196 | E | * | 1/1980 | Velarde | 29/243.56 |
| 4,196,514 | A | | 4/1980 | Merriman | |
| 4,341,303 | A | * | 7/1982 | Britt | 206/343 |
| 4,509,231 | A | * | 4/1985 | Paxton | 24/30.5 R |
| 4,534,149 | A | * | 8/1985 | Hoyland | 53/76 |
| 4,648,415 | A | | 3/1987 | Yuan | |
| 4,776,090 | A | | 10/1988 | Grassi | |
| 4,809,431 | A | | 3/1989 | Idema | |
| 5,000,070 | A | * | 3/1991 | Ozawa et al. | 83/582 |
| 5,052,416 | A | | 10/1991 | Rommerdale | |
| 5,063,666 | A | | 11/1991 | Tsay | |
| 5,074,041 | A | | 12/1991 | Wagner | |
| 5,129,210 | A | * | 7/1992 | Cicatello et al. | 53/138.1 |
| 5,133,132 | A | | 7/1992 | Yu | |
| 5,249,517 | A | * | 10/1993 | Massman | 100/4 |
| 5,488,772 | A | | 2/1996 | Dababneh et al. | |
| 5,522,136 | A | | 6/1996 | Larisey | |
| 5,735,101 | A | * | 4/1998 | Shing-Tak Lam | 53/136.1 |
| 5,806,186 | A | | 9/1998 | Langman et al. | |
| 6,098,370 | A | | 8/2000 | Kobayashi et al. | |
| 6,173,497 | B1 | | 1/2001 | Domenge | |
| 7,434,369 | B2 | * | 10/2008 | Uneyama et al. | 53/136.3 |
| 2007/0107378 | A1 | * | 5/2007 | Frazier | 53/138.8 |

FOREIGN PATENT DOCUMENTS

| | | |
|---|---|---|
| GB | 1 038 510 | 8/1966 |
| GB | 1 328 146 | 8/1973 |

OTHER PUBLICATIONS

PCT/US05/039680 Search Re, Jan. 8, 2007, Irwin.

PCT/US05/039680 Written Opi, Jan. 8, 2007, Irwin.

* cited by examiner 30
28
10
24
18
26

42
16
14
56
22
54
62
33
37
41
60
61
58
44
38
32
48
63
59
40
35
39
36
34
12
52
46
50
20

18
30
28
24
26
64

66
42
70
92
84
72
82
74
80
68
76
78
88
86

98
96
134
168
171
42
132
171
171
168
165
165
179
178
171
168
168
92
159
160
177
176
165
169
165
100
166
172
172
173
154
162
174
170
169
156
167
166
116
184
182
173
186
188
120
180
170
167
24
161
163
26
164

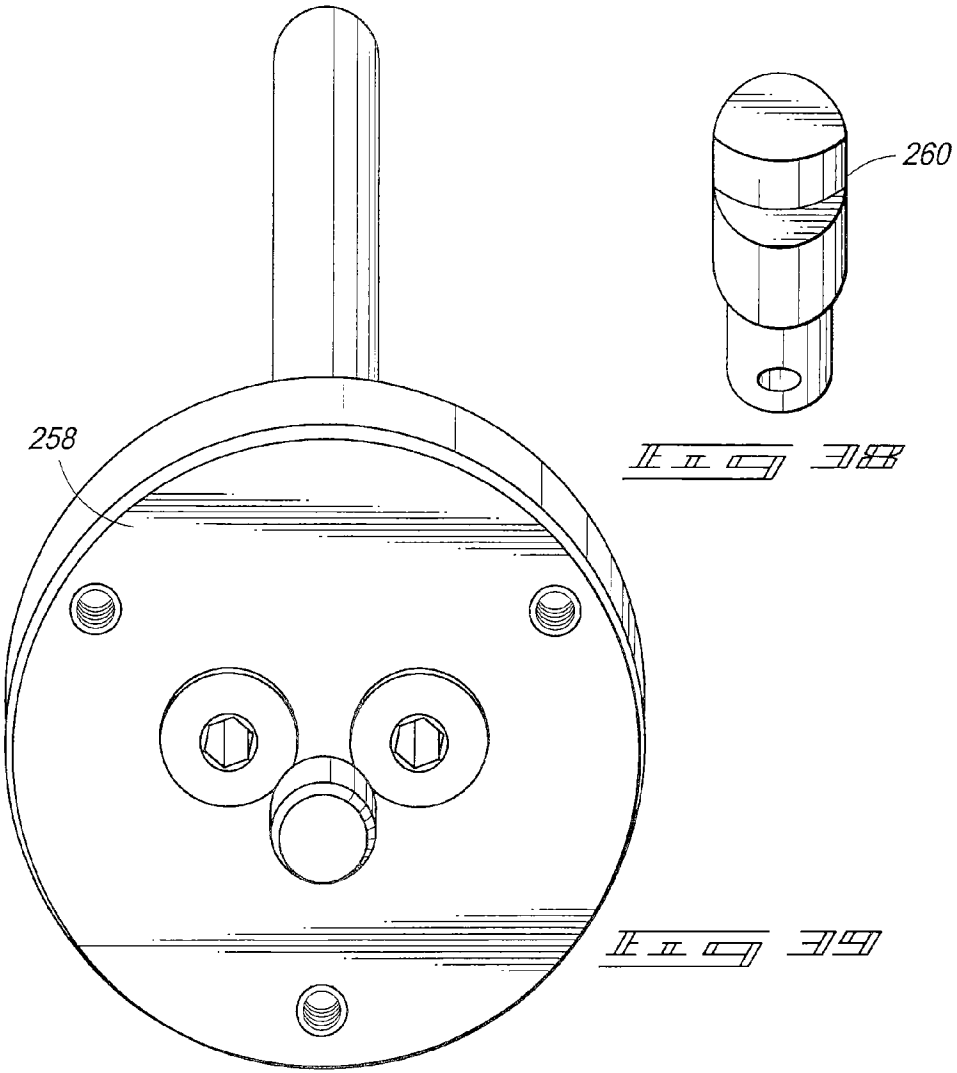
FIG 26
FIG 27
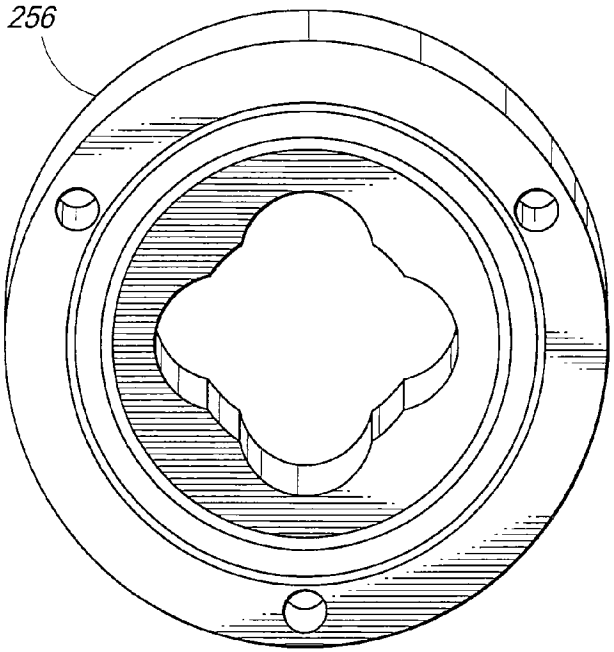
FIG 28

1096

1096
1098

1098
1174
1126
1128

APPARATUS AND METHOD FOR SEVERING AND LOADING BAG FASTENERS

RELATED PATENT DATA

This application is a Divisional application of U.S. Pat. application Ser. No. 11/265,430 which was filed Nov. 1, 2005, now U.S. Pat. No. 7,596,928 issued Oct. 6, 2009, which claimed priority to U.S. Provisional Patent Application Ser. No. 60/624,672 which was filed Nov. 2, 2004, and the entirety of which are incorporated by reference herein.

TECHNICAL FIELD

This invention pertains to article bagging systems and methods. More particularly, the present invention relates to machines and methods for applying bag clips, or closures, about the neck of the bag after the bag has been filled with one or more items, such as a stack of thermoformed articles, by severing the clip from a strip of clips.

BACKGROUND OF THE INVENTION

Previous machines are known for preparing and applying clips onto the neck of a plastic bag. For example, U.S. Pat. Nos., 3,163,969 and 3,163,972 disclose methods and apparatus for applying bag closures, or clips, onto the open neck portion of a plastic bag inside of which articles have previously been inserted. According to these methods and apparatus, a contiguous strip of clips is made of relatively brittle plastic material, and a clip is delivered and severed by bending and snapping the clip from the strip of clips. However, small fragments or pieces of material can sometimes break loose when snapping the clip, and the fragment can then contaminate a packaging operation. Attempts have been made to form bridges between adjacent clips in order to add predictability to the fracture process. However, these bridges can sometimes serve to form the fractured fragments. Secondly, a fractured surface is not always formed along a predictable path, which means that some clips can be imparted with a rough or even sharp edge that can be uncomfortable or dangerous in the hands of a user that is re-applying or removing a clip from a bag.

As the operating speeds of thermoforming machines and bagging machines have increased, this problem has been exacerbated as the increased speeds frequently lead to an increase in the misapplication and severing of clips from a strip of clips. In the process of designing newer and faster thermoforming lines and bagging machines for thermoformed articles, it has been realized that improvements are now needed in the design of bag closing machines in order to more accurately, quickly, and repeatedly apply clips onto plastic bags that contain articles. Furthermore, there exists a need to generate a more predictable and predetermined edge surface on a clip when severing the clip from a strip of clips. Even furthermore, environmental pollution concerns have lead to a need to provide a new mechanism for severing clips from a strip of clips which will enable construction and use of clips that are more environmentally friendly. Presently used frangible clips are constructed from plastic which is not environmentally friendly.

Accordingly, improvements are needed in the manner in which a clip is delivered onto an open neck portion of a plastic bag via a bag closing machine, wherein a clip is applied onto the open neck portion of the bag to close the bag and is then severed from a strip of clips.

SUMMARY OF THE INVENTION

A bag closing apparatus and method is provided for loading a clip onto an open neck portion of a bag where the bunched-up open neck of the bag is delivered into a clip and the clip is severed from a neighboring, contiguous strip of clips with a pair of co-acting and opposed cutting edges. In one case, the clip is a polyethylene clip. In other cases, the clip is made from biodegradable material such as paper.

According to one aspect, a clip-separating machine is provided with a guide frame, a clipper, and a displacement structure. The guide frame is configured to support a strip of clips. The clipper has a pair of opposed cutting edges. One of the edges is supported for movement toward and away from another of the edges. The displacement structure is configured to move the one cutting edge toward the other cutting edge so as to cause co-action of the cutting edges to sever a terminal clip from a strip of clips.

BRIEF DESCRIPTION OF THE DRAWINGS

Preferred embodiments of the invention are described below with reference to the following accompanying drawings.

FIG. 32 is a top view illustrating a clip deflecting plate removed from the bag closing device and manually held in engagement against a clip in order to simulate the manner in which the clip deflecting plate torsionally biases a clip to open up an open neck portion of the clip during loading of an open neck portion of a bag therein via the machine.

FIG. 33 is a front view of a clip deflecting plate removed from the bag closing device and held in engagement against a clip in order to simulate the manner in which the clip deflecting plate torsionally biases a clip to open up an open neck portion of the clip during loading of an open neck portion of a bag therein via the machine.

FIG. 38 illustrates a rotatable cam clutch pin for use in the clutch of the bag closing machine.

FIG. 39 illustrates the clutch component that is carried within the clutch bell.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Reference will now be made to a preferred embodiment of Applicant's invention. More particularly, a bag closing device is provided for use within a bag fastening system to improve the ease, effectiveness, and speed with which a bag fastening system is capable of operating. While the invention is described by way of a preferred embodiment, it is understood that the description is not intended to limit the invention to such embodiments, but is intended to cover alternatives, equivalents, and modifications which may be broader than the embodiments, but which are included within the scope of the appended claims.

In an effort to prevent obscuring the invention at hand, only details germane to implementing the invention will be described in great detail, with presently understood peripheral details being incorporated by reference, as needed, as being presently understood in the art.

Figure 1:
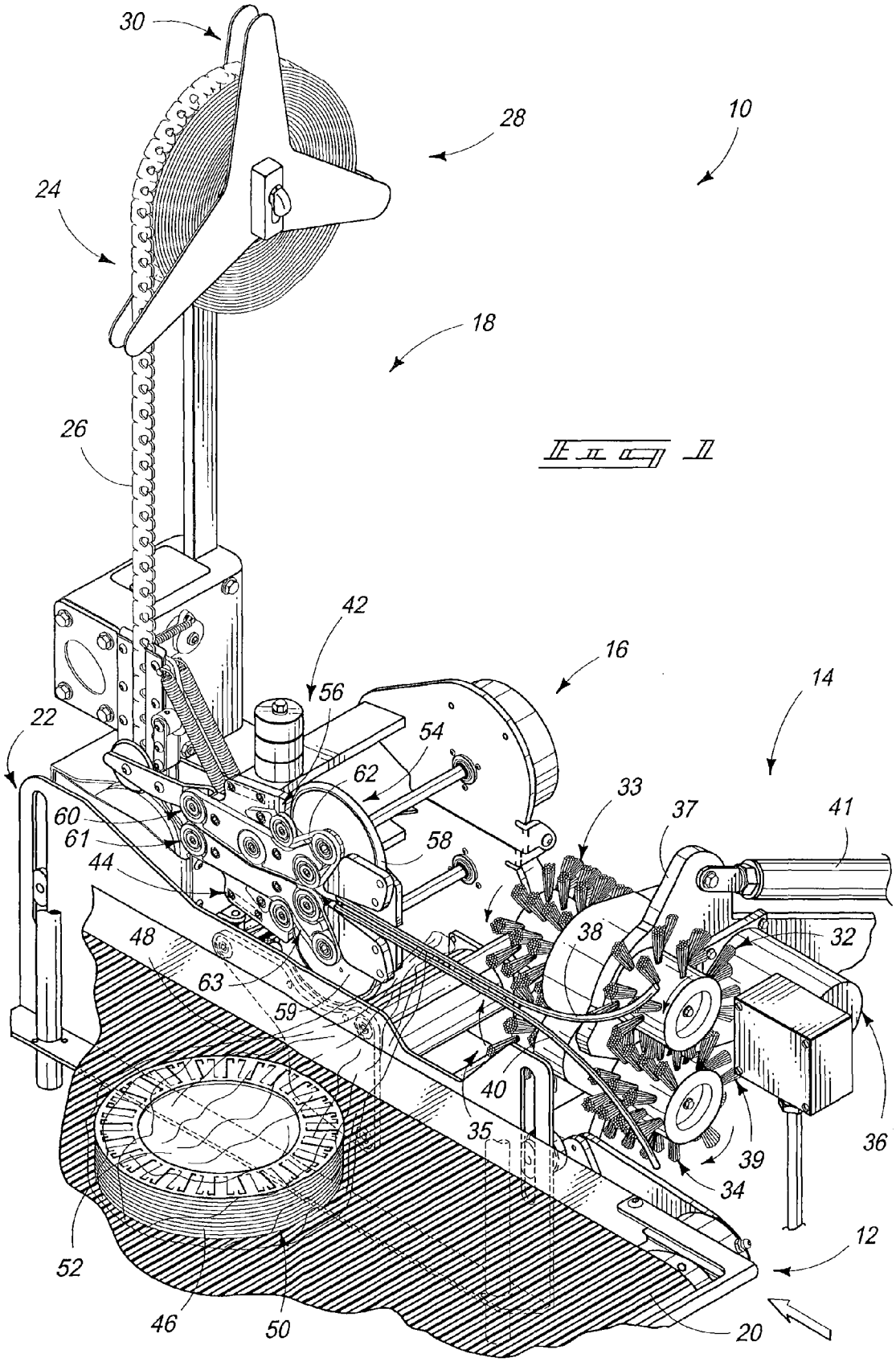
FIG. 1 is a simplified partial perspective view of a bag fastening system with a conveyor table, a bag arranging device, a bag accumulating device, and a bag closing device, and particularly emphasizing features of the bag closing device according to one aspect of the present invention.

FIG. 1 illustrates a bag fastening system 10 that incorporates novel features of the present invention that sever a clip (or lock) from a strip of clips as taught and claimed herein. Bag fastening system 10 includes a substantially horizontal conveyor table 12 configured and arranged to support a bag arranging device 14, a bag accumulating device 16, and a bag closing device 18. Devices 14, 16, and 18 are mounted side-by-side along one edge of a conveyor belt 20. Conveyor belt 20 moves article-filled bags such that an open neck portion of each bag is disposed towards devices 14, 16, and 18. More particularly, bags of articles are conveyed along conveyor belt 20 from an upstream direction adjacent device 14 and toward a downstream direction adjacent device 18. In the process, bag arranging device 14 flattens and aligns the open neck portion of each bag. Bag accumulating device 16 then bunches up the open neck portion to reduce width of the open neck portion as the bunched-up open neck portion is then conveyed into bag closing device 18. The bunched-up open neck portion is then delivered into a closure aperture of a clip (otherwise referred to as a closure or a lock) on bag closing device 18 which is attached to and subsequently severed from a string of clips. The entire operation is performed sequentially as a bag of articles is conveyed in a downstream direction by conveyor belt 20.

As shown in FIG. 1, a table elevator mounting assembly 22 is provided on a side edge of conveyor table 12 for adjusting in unison the elevation of bag arranging device 14, bag accumulating device 16, and bag closing device 18. Accordingly, the horizontal plane in which an open neck (or mouth) portion of a bag is horizontally flattened via device 14, bunched up via device 16, and closed via device 18 can be adjusted relative to the horizontal plane of conveyor belt 20. Such adjustment may be desirable when the thickness of an article (or stack of articles) that is loaded into a bag is changed. For example, one condition may require the bagging of a stack of 25 thermoformed plates into a polyethylene plastic bag, whereas a second operation may require the bagging of 50 plates. Hence, the optimal elevational position for horizontally flattening, bunching, and closing an open neck portion of a bag can be optimally adjusted by raising or lowering devices 14, 16, and 18 to a desired elevation relative to the plane of conveyor belt 20.

As shown in FIG. 1, an array (or strip) 24 of individual clips (or closures) 26 are stored as a roll 28 on a reel assembly 30 of bag closing device 18. Bag closing device 18 severs individual clips 26 from strip 24 by cutting individual clips 26 from strip 24 after a bunched, open neck portion of a plastic bag is accumulated inside clip 26. Optionally, a bag closing device as taught in U.S. Pat. Nos. 3,163,969 and 3,163,972 can be used in place of bag closing device 18 to apply clips to a bag neck by bending and snapping off individual clips.

With the exception of adding the new features of clip cutting mechanism 42 (see FIG. 2 and alternative embodiment clip cutting mechanism 1042 of FIGS. 45-46), the bag closing device 18 operates essentially the same as the bag closing device of U.S. Pat. Nos. 3,163,969 and 3,163,972. However, the substitution of devices 42 (and 1042) completely changes the manner in which a clip is severed from a strip of clips. Instead of bending and breaking off a frangible clip, a clip is cut between coacting cutting edges which enables the use of non-frangible materials (as well as frangible materials) when making strips of clips. U.S. Pat. Nos. 3,163,969 and 3,163,972 are incorporated herein by reference in order to illustrate construction and operation of such devices.

According to FIG. 1, bag arranging device 14 is provided upstream of bag accumulating device 16 in order to flatten and smooth out an open neck portion of a plastic bag to prepare the bag to be advanced into bag accumulating device 16. In operation, bag arranging device 14 cooperates with a pair of guide bars 38 and 40 of bag accumulating device 16 to guide, flatten, and smooth out the open neck portion of a bag in which articles have been previously deposited. More particularly, two sets of brushes 32, 34 and 33, 35 each cooperate in counter-rotation to draw the open neck portion of the bag into and between the two sets of brushes. The open neck is drawn between the sets of brushes 32, 34 and 33, 35 until a stack of articles within the bag is engaged against guides 38 and 40 such that the articles are driven into the bottom of the bag and the free edge of the bag is further drawn in between the sets of brushes 32, 34 and 33, 35. In this manner, it is ensured that articles within a plastic bag are driven to the bottom of the bag and the open neck portion of the bag becomes free and is straightened out and smoothed over between the respective pairs of counter-rotating brushes.

More particularly, an alternating current (AC) motor 36 is configured to drive cylindrical brushes 32 and 33 in one direction, about a common axis, while driving brushes 34 and 35 in an opposite, counter-rotating direction along a second, common axis. Brushes 32, 34 and 33, 35 are driven so as to provide an entrance nip between the brushes on a side adjacent to guides 38 and 40. Accordingly, an open neck portion of a plastic bag is drawn in between brushes 32 and 34 until contents (such as articles) within the bag engage against guide bars 38 and 40, which forces the contents to the bottom of the bag and draws a resulting free portion of the open neck portion between the brushes where such open neck portion is flattened and generally smoothed out for presentment into bag accumulating device 16. According to one implementation, brushes 32, 34 and 33, 35 are rotated in opposite directions at 450 revolutions per minute (RPM). Other operating speeds are also possible.

As shown in FIG. 1, bag arranging device 14 includes an upper frame 37 that is pivotally supported by a lower frame 39 via a hinge having a pivot axis. Upper frame 37 is held in a desired pivoted position relative to lower frame 39 using a length-adjustable threaded rod support 41 that adjusts and fixes the pivotal positioning of upper frame 37 relative to lower frame 39 by modifying the length of rod support 41 via rotation of a threaded rod within a nut at each end. As a result, the distances between brushes 32, 34 and 33, 35 can be adjusted which can help enhance performance when bag properties and operating speeds are changed. Motor 36 has a drive shaft with a chain sprocket that drives a chain. The chain drives a sprocket in the upper frame in a first direction, and the chain is twisted a half turn to drive a sprocket in the lower frame in a second, opposite direction. An idler sprocket guides the twisted chain and is spring biased to tension the chain.

According to one construction, brushes 32 and 33 are driven by a common shaft having a chain sprocket that is driven by a drive chain. Likewise, brushes 34 and 35 are driven by a similar chain sprocket via the chain, which has a half-turn twist that drives brushes 34 and 35 in counter-rotation relative to brushes 32 and 33 with the help of an idler sprocket. Brushes 32-35 are each formed from groups of flexible synthetic plastic bristles.

According to one construction, brushes 32 and 35 have relatively stiff bristles, whereas brushes 33 and 34 have relatively soft bristles. One suitable relatively stiff bristle is a black Type 6.6 nylon crimped bristle with a 0.010-inch diameter. One suitable relatively soft bristle is a black Type 6.6 nylon crimped bristle with a 0.006-inch diameter. These brushes are sold by Carolina Brush Company, of Gastonia, N.C.

It has been discovered that counter-rotation of stiff bristles 32 against relatively soft bristles 34 imparts flexing of bristles 34 which tends to grab and flatten out the top section of an open neck portion on a plastic bag, whereas relatively stiff bristles 35 tend to co-act and flex against relatively soft bristles 33 so as to more effectively grab and flatten a bottom section of an open neck portion on a plastic bag. Hence, bag arranging device 14 more effectively flattens and smoothes out an open neck portion of a plastic bag by initially more effectively gripping the upper section of the open neck portion and subsequently more effectively gripping the lower section of the open neck portion. Typically, adjustment rod 41 is adjusted in axial length for a specific bag construction, such as a bag having a desired plastic material and thickness. One typical adjustment causes brushes 32, 34 and 33, 35 to have a slight interference fit such that the relatively stiff bristles tend to flex the relatively soft bristles to a greater degree than the stiff bristles as the respective brushes co-act on opposite sides of an open neck portion of a plastic bag.

According to one implementation, bag fastening system 10 is designed to be used downstream of a bagging machine that receives stacks of articles from a thermoforming line. For example, plates formed from thermoformable plastic foam sheet material are delivered from a thermoforming line in stacks of a pre-selected quantity. The stacks of plates are then conveyed onto a bagging machine where they are delivered into a folded film of material, after which bags are formed from the film about the stacks of plates. The bagged plates are then delivered into a bag fastening system 10 (see FIG. 1) where the open neck portions of the bags are arranged, accumulated, and then closed with a bag closure or clip.

As shown in FIG. 1, a plastic bag 46 and a stack 50 of articles (e.g., thermoformed plates) 52 are progressively moved through bag fastening system 10. A bag 46 of stacked articles 52 is received from a bagging machine onto conveyor table 12. Bag 46 and articles 52 are conveyed along conveyor belt 20 in a downstream direction with an open neck portion 48 of bag 46 oriented toward devices 14, 16, and 18. More particularly, bag 46 is deposited onto belt 20 so as to convey open neck portion 48 between upper guide bar 38 and lower guide bar 40 of device 16.

Guide bars 38 and 40 extend laterally upstream a sufficient distance so as to provide guidance of neck portion 48 into bag arranging device 14. Guide bars 38 and 40 diverge in an upstream direction to ensure capture of the open neck portions 48 of bags 46. Guide bars 38 and 40 cooperate to guide and orient open neck portion 48 for passage between pairs of counter-rotating brushes 32, 34 and 33, 35. Co-action between brushes 32, 34 and brushes 33, 35 serves to pull open neck portion 48 into and between the respective pairs of brushes, which draws bag 46 toward device 14 until stack of articles 52 engages against guide bars 38 and 40. As articles 52 engage against guide bars 38 and 40, articles 52 are driven into the bottom of bag 46 which provides for an increased (or maximized) amount of free material, thereby lengthening open neck portion 48. Accordingly, an additional length of open neck portion 48 is drawn between brushes 32, 34 and 33, 35 as articles 52 are driven to the bottom of bag 46.

Bag arranging device 14 is supported about a pivot point for pivotal positioning in a horizontal plane so that the orientation of brushes 32, 34 and 33, 35 can be rotated to be parallel with a side edge on table 12 or they can be rotated to form an acute skew angle with the side of table 12 either on an upstream side, or on a downstream side. Such adjustments in positioning are desirable based upon the specific type of bag and thickness of bag being presented into device 14.

According to one implementation, bag 46 comprises a clear polyethylene plastic bag. However, it is possible that other types of bags can be processed through bag fastening system 10 including Mylar® bags, paper bags, and woven bags, including cloth bags. Mylar® is commercially available from E.I. Du Pont De Nemours and Company, of Wilmington, Del.

Figure 2:
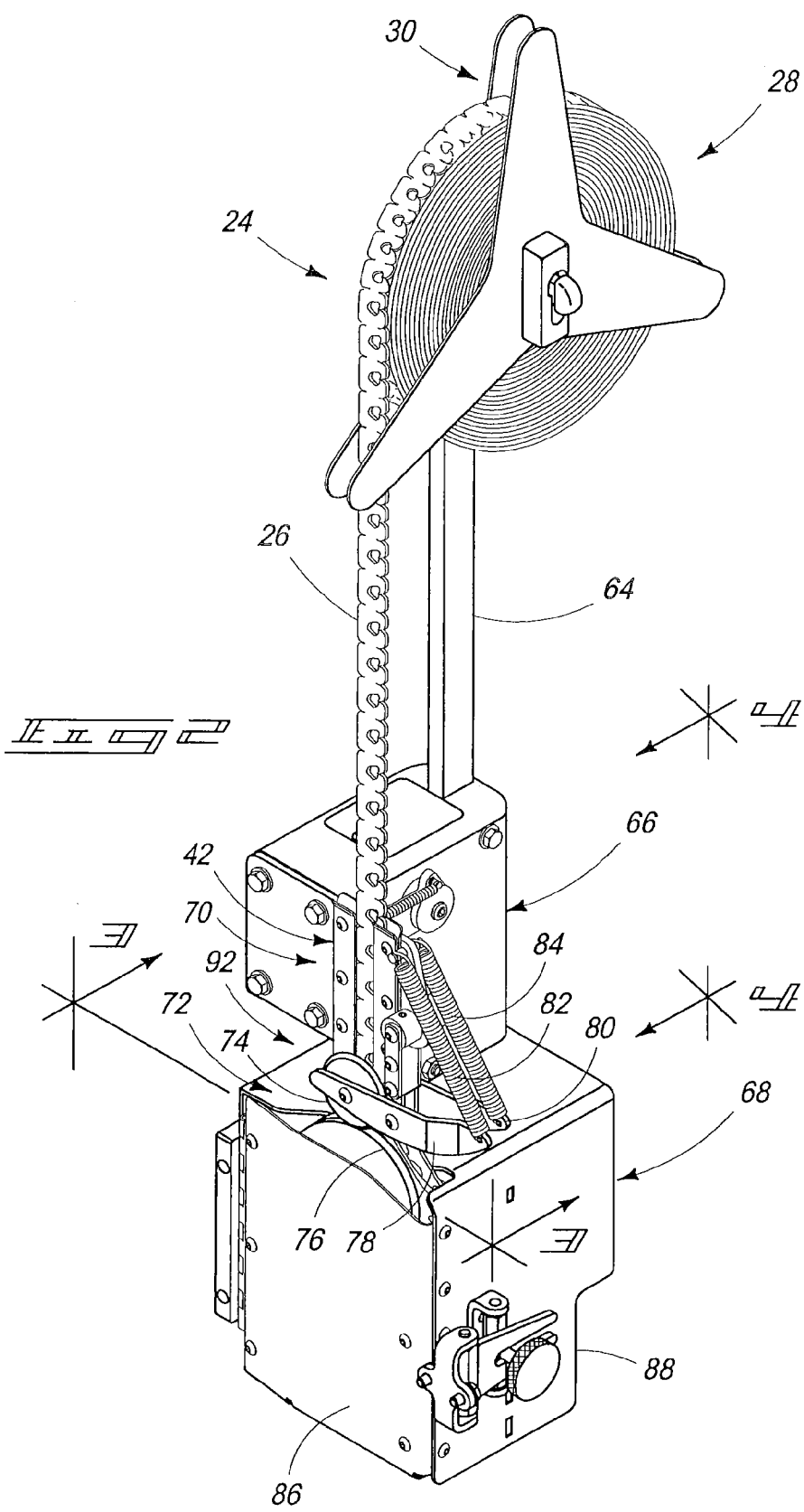
FIG. 2 is an enlarged partial perspective view of the bag closing device of FIG. 1.

FIG. 2 illustrates one bag closing device of the present invention incorporating a clip separating machine 92 that is an improvement over prior art bag closing devices. Clip separating machine 92 includes clip cutting mechanism 42. Alternatively, clip separating machine 92 includes clip cutting mechanism 1042 of FIGS. 45-46 which alternatively uses straight cutting edges. Prior art bag closing devices are constructed in essentially a similar manner as is disclosed in U.S. Pat. Nos. 3,163,969 and 3,163,972. In the present case, bag closing device 18 is constructed in a similar manner but device 18 includes a significant operational modification in that clip separating machine 92 cuts or severs individual clips 26 from an integrally formed continuous strip 24 of clips 26. In contrast with prior art techniques, clips 26 are not bent and snapped off of strip 24. Instead, a pair of co-acting cutting edges or blades are brought into opposed engagement on opposite sides of strip 24 to sever individual clips 26 from adjacent clips.

As shown in FIG. 1, bag accumulating device 16 includes a wheel drive mechanism 54 and a track drive mechanism 56 provided downstream of mechanism 54. Mechanism 54 includes a pair of co-acting wheels 58 and 59, whereas track drive mechanism 56 includes a pair of co-acting track assemblies 60 and 61. Track assemblies 60 and 61 each include an elastic O-ring shaped band 62 and 63, respectively.

As shown in FIG. 2, bag closing device 18 includes a reel assembly 30 on which a roll 28 includes a strip 24 of clips 26. Reel assembly 30 is mounted atop a rigid structural support post 64 that extends from an upper housing assembly 66 that is provided atop a lower housing assembly 68.

As shown in FIG. 2, clip strip feeder mechanism 70 is provided on the front of upper housing assembly 66. Clip separating machine 92 is provided along the downstream end of feeder mechanism 70. A bag neck delivery wheel assembly 72 is provided by a pair of upper wheels, such as wheels 74 and 75, and a pair of co-acting wheels, such as wheels 76 and 77. Wheels 74 are carried by pivotally supported arms 78, whereas wheels 75 are supported for rotation at the end of pivotally supported arm 80 (see FIG. 4). Arms 78 and 80 are pivotally supported so as to engage wheels 74 and 75 against wheels 76 and 77, respectively, through springs 82 and 84, respectively, which are placed in tension. Finally, bag closing device 18 is mounted onto a conveyor table along a support base plate 86. Base plate 86 is pivotally supported via housing 88 of lower housing assembly 68.

Figure 3:
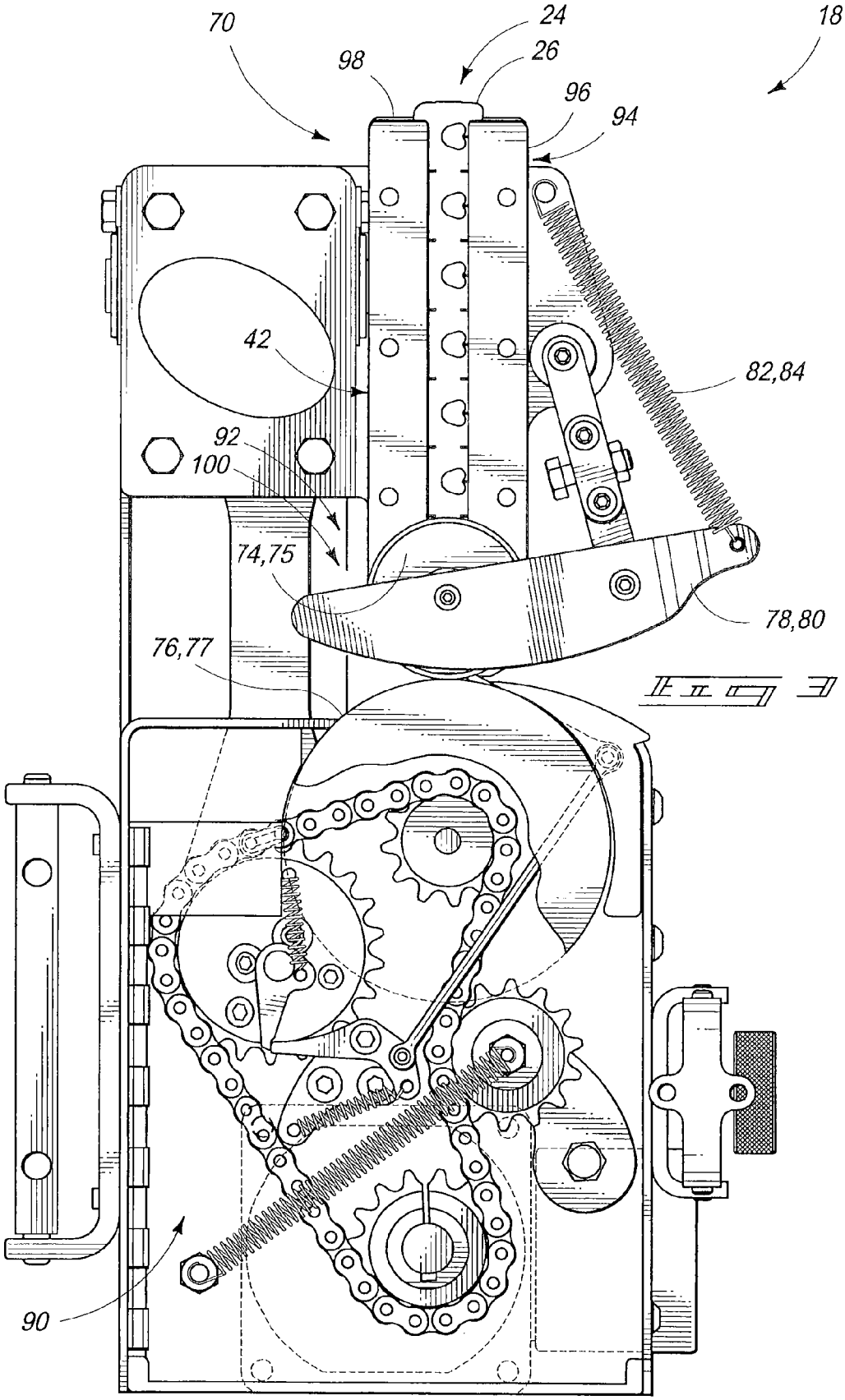
FIG. 3 is an enlarged vertical view taken along line 3-3 of FIG. 2 with portions in partial breakaway and showing a base plate removed to enable viewing of an internal drive mechanism.

FIG. 3 illustrates in enlarged detail components of fixed housing assemblies 66 and 68. More particularly, an internal drive mechanism 90 is shown within the lower housing assembly as the base plate has been removed from the drawing in order to facilitate viewing therein.

As shown in FIG. 3, clip separating machine 92 is capable of being retrofit onto prior art bag closing devices, such as those disclosed in U.S. Pat. Nos. 3,163,969 and 3,163,972. In order to implement such a conversion, clip strip feeder mechanism 70 is mounted onto such a bag closing device along with clip separating machine 92 which severs clips 26 from continuous strip 24 of such clips 26. Details of clips 26 are disclosed in Appendix D attached hereto.

Figures 8, 9, 10:
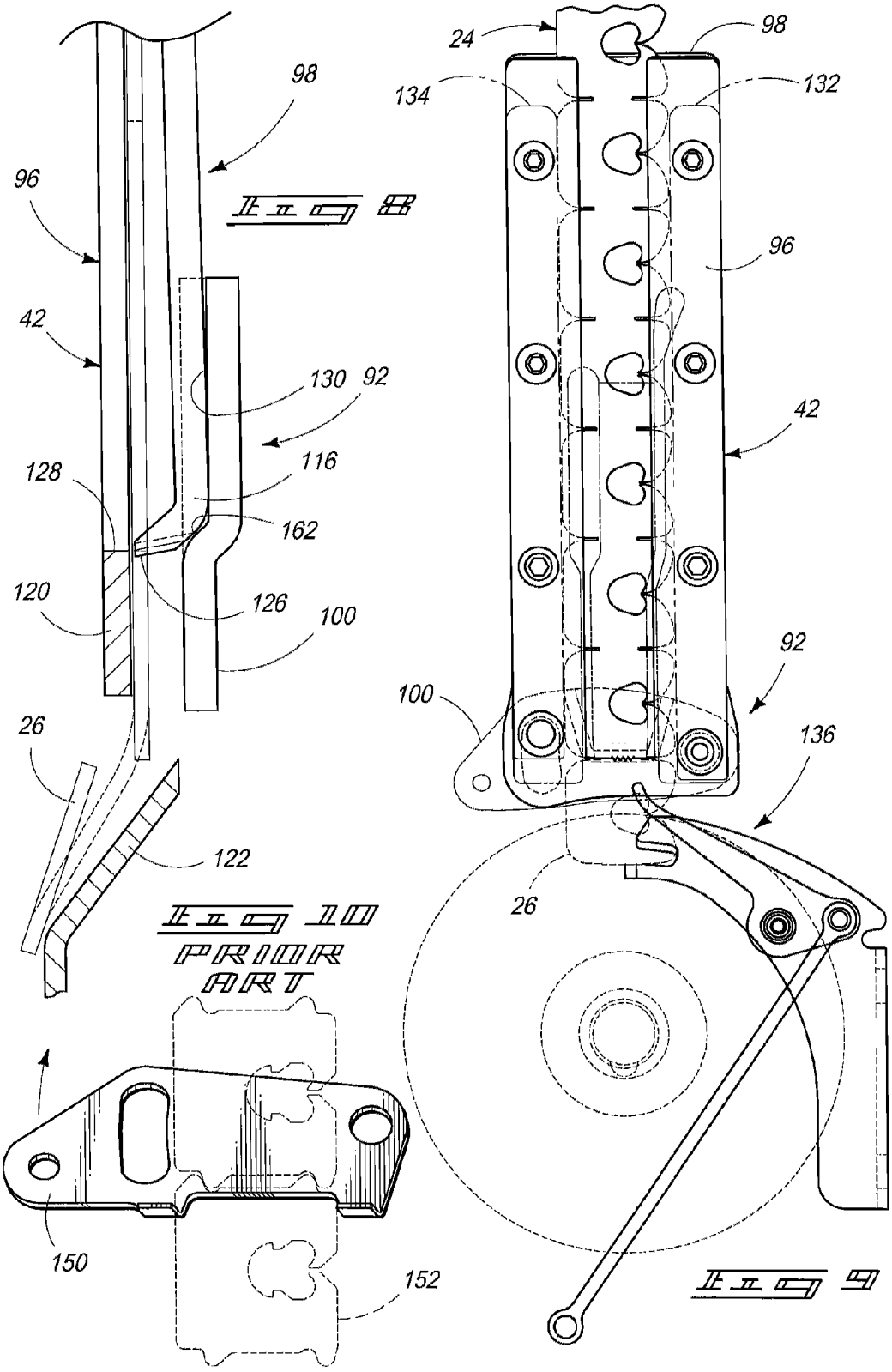
Fig 10 PRIOR ART
FIG. 8 is a further enlarged vertical sectional view of selected components taken from the encircled region 8 of FIG. 7.
FIG. 9 is an enlarged partial vertical front view of selected components in a subassembly of a clip strip guide assembly, bag neck feeding rotor, and trigger mechanism.
FIG. 10 is an enlarged perspective view of a prior art web breaking rocker plate.

As disclosed herein, bag closing device 18 employs many of the prior art construction techniques, but adds the additional benefits and modifications provided by feeder mechanism 70 and clip separating machine 92. As shown herein, feeder mechanism 70 guides and delivers strip 24 of clips 26 down between a strip guide assembly 94 comprising a front clip guide plate 96 and a rear clip guide plate 98. A cam cut-off plate 100 (see FIG. 5) is pivotally mounted for up-and-down motion in a manner that engages and disengages a pair of co-acting cutting edges provided on each of plates 96 and 98. The co-acting cutting edges are brought together to sever an individual clip 26 from strip 24. Prior art techniques utilized a prior art cam plate that bent and snapped a prior art clip from a strip of clips, as shown in FIG. 10. The present invention does not bend an individual clip to sever it from a strip of clips. Instead, the clip 26 is severed from a strip 24 by a pair of co-acting edges that cooperate similar to the manner that a toenail clipper is used to sever a nail segment from an individual's toenail. It is understood that other techniques may be used to sever or cut an individual clip 26 from a contiguously formed strip 24 of such clips 26.

As further shown in FIG. 3, tension springs 82 and 84 pivotally bias arms 78 and 80 so as to engage wheels 74 and 75, respectively, against wheels 76 and 77.

Figure 4:
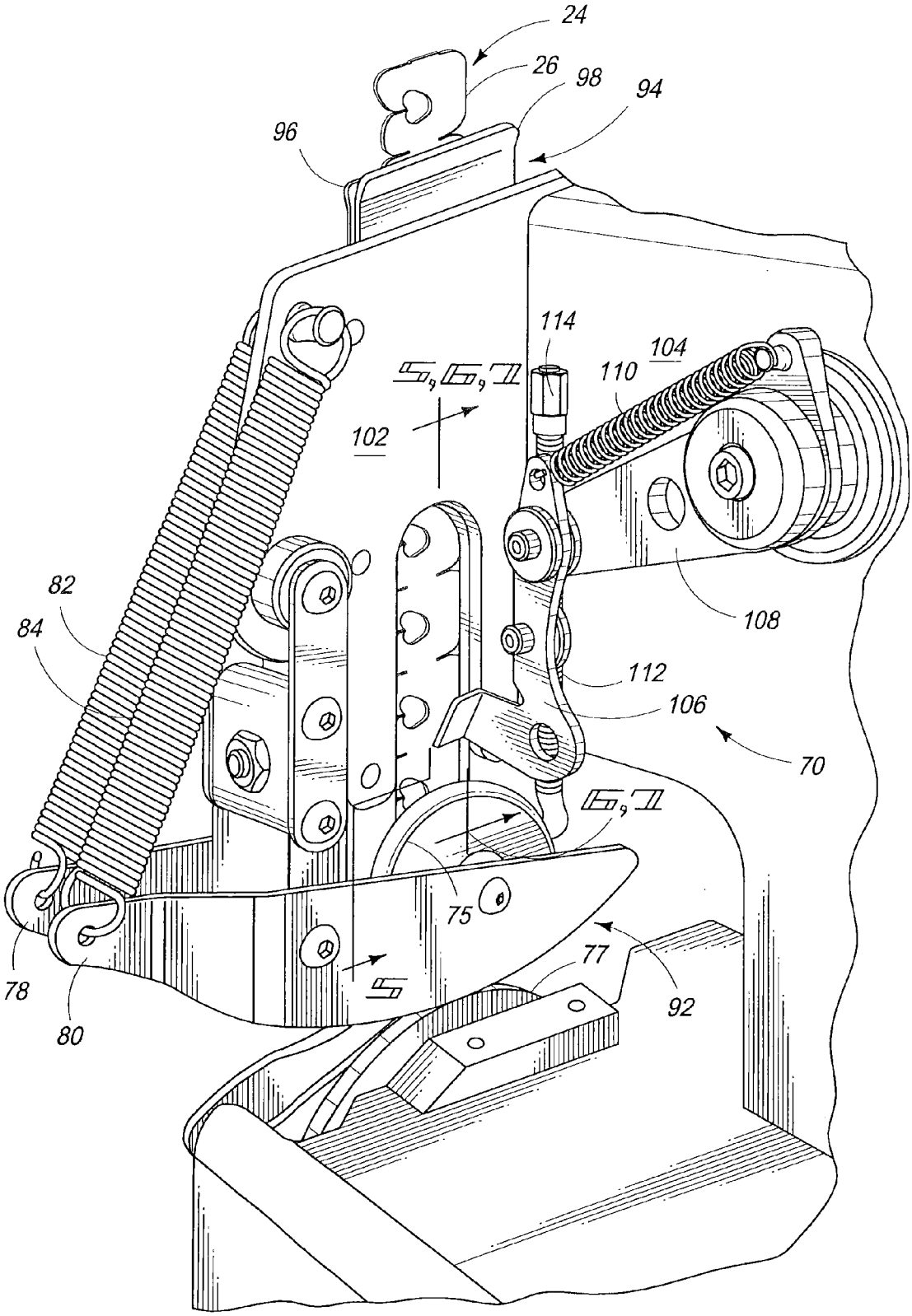
FIG. 4 is an enlarged partial breakaway perspective view taken along arrow 4 of FIG. 2.

As shown in FIG. 4, clip strip feeder assembly 70 is formed by the strip guide assembly 94 provided by guide plates 96 and 98 in combination with the clip strip feed finger 106 that incrementally downwardly feeds individual clips 26 and strip 24 by engaging a rear-most gap between adjacent clips 26 to downwardly feed an individual clip length via pivotal oscillation of an actuator arm 108 via tension spring 110. Actuator arm 108 is pivotally driven, as previously known in the art, so as to move actuator arm 106 to incrementally advance clips one at a time for severing from the strip 24. A tension spring 112 on a link rod 114 upwardly biases a mounting bracket 118 that is pivotally fixed to an outboard end of cam cut-off plate 100 (see FIG. 3), similar to the manner in which the prior art cam plate 150 of FIG. 10 is pivotally driven to bend and snap off individual clips from a strip, according to prior art techniques.

As shown in FIG. 4, wheel 75 is shown pivotally mounted on arm 80 under compressive engagement via tension of spring 84 against wheel 77. Similarly, wheel 74 (see FIG. 3) is supported for rotation by arm 78 via compression of spring 82 for engagement against respective wheel 76 (see FIG. 3).

Figure 5:
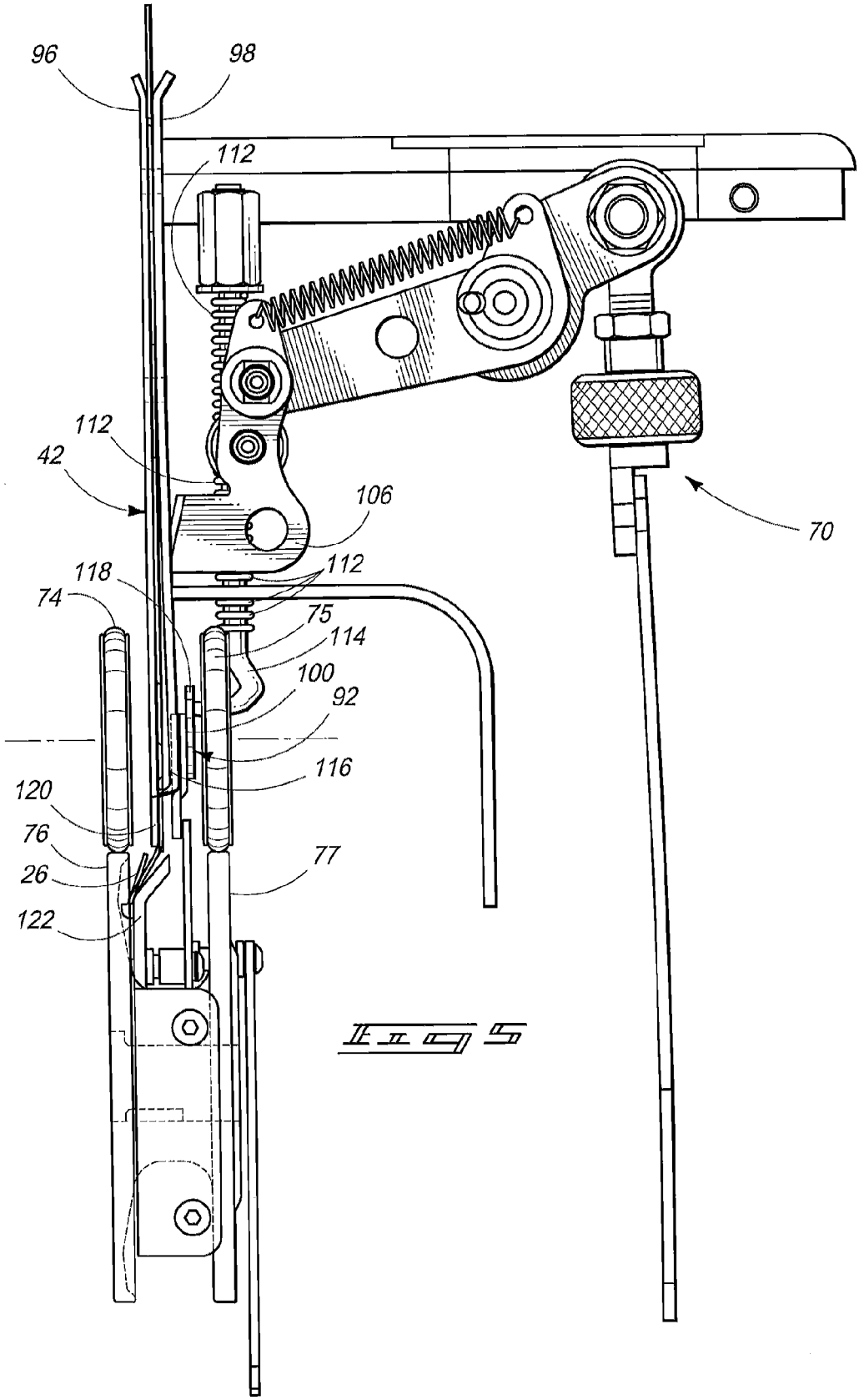
FIG. 5 is an enlarged vertical side view of a subassembly of selected components taken along line 5-5 of FIG. 4 and illustrating only selected components.

FIG. 5 illustrates selected drive components from clip strip feeder mechanism 70 that drive feed finger 106 for advancing individual clips 26 between guide plates 96 and 98. Cam plate 100 is upwardly driven to drive a flexible finger 116 of guide plate 98 toward guide plate 96, which causes severing of an adjacent clip 26. Finger 116 scissors in engagement alongside a knife edge on a stationary base edge 120 of guide plate 96.

As previously known in the art, a clip deflecting plate 122 is articulated into position to twist clip 26 so as to open a mouth portion and prepare the clip to receive a bunched-up open-neck portion of a bag during a bag loading operation, prior to severing clip 26 from an adjacent strip. Also shown in FIG. 5, wheels 74 and 75 are biased for counter-rotation against wheels 76 and 78 between which an open neck portion of a bag is received, as shown below with respect to FIG. 7.

Figure 6:
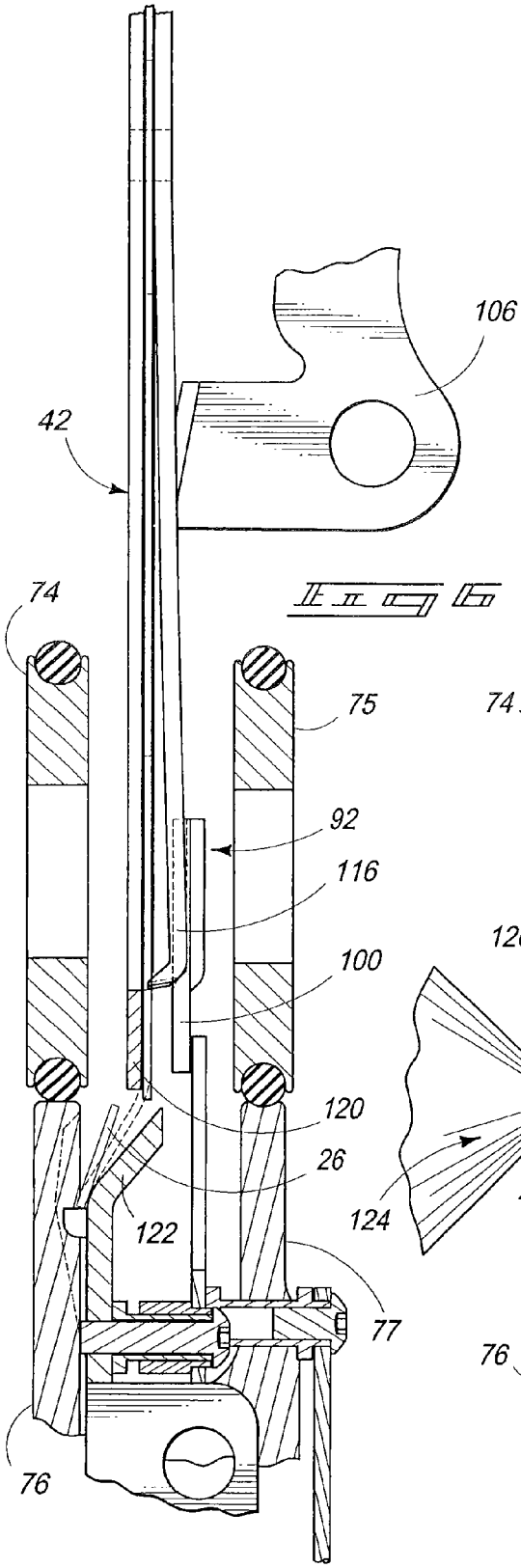
FIG. 6 is an enlarged vertical sectional view of selected components taken along line 6-6 of FIG. 3 and illustrating only selected components.

FIG. 6 shows in greater detail the positioning of finger 116 relative to stationary base edge 120 in relation to cam cut-off plate 110, prior to cam cut-off plate 110 being upwardly rotated. Upward rotation of cam cut-off plate 110 drives finger 116 towards and across the sharp top edge of stationary base edge 120. Such upward movement of plate 110 causes a scissoring action between finger 116 and stationary base edge 120 which severs a clip from a strip of clips therebetween.

Figure 7:
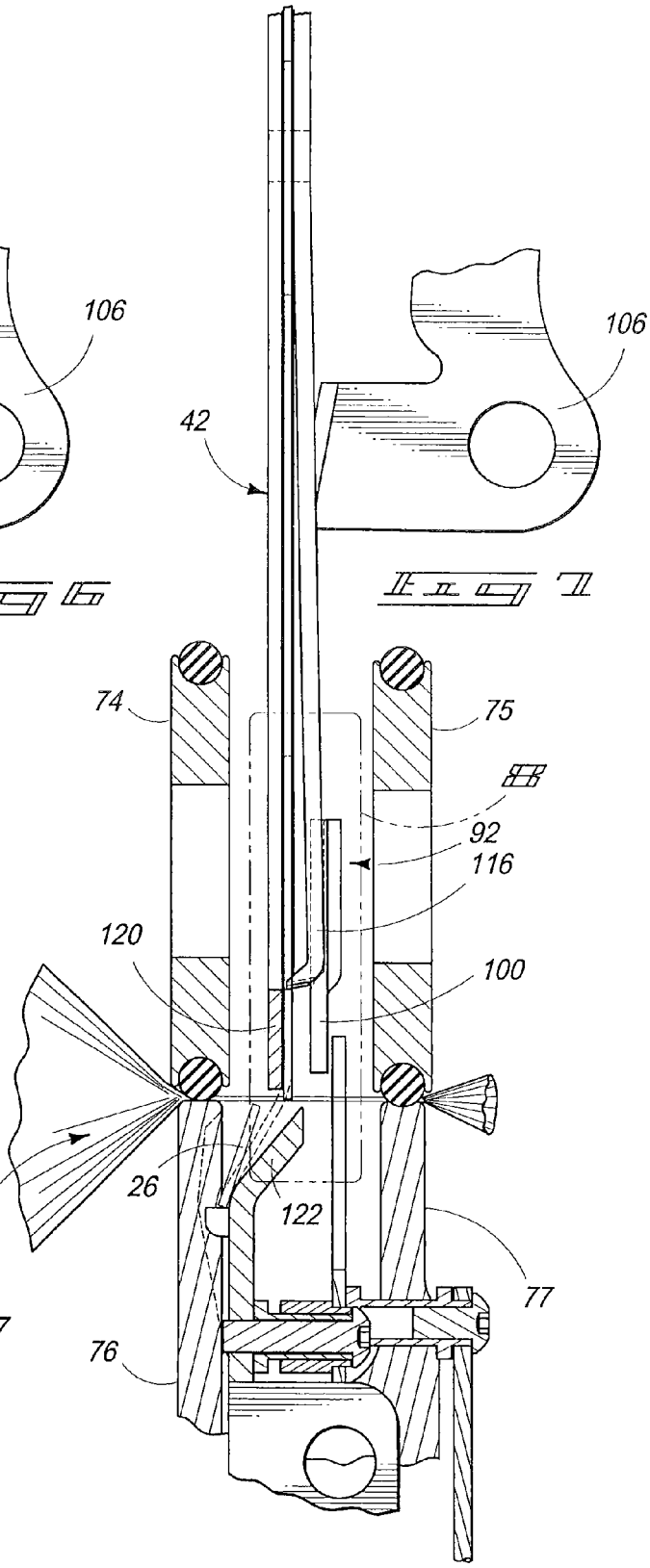
FIG. 7 is a vertical sectional view of selected components corresponding with the view of FIG. 6, but taken later in time and showing an open neck portion of a bag delivered into a clip that is biased so as to present an open mouth portion.

FIG. 7 illustrates the loading of an open neck portion 124 of a bag into a clip 26 that is biased and twisted via clip deflecting plate 122 for loading therein. Finger 116 is shown just prior to upward driven engagement of plate 100 prior to severing clip 26 from an adjacent strip of clips.

FIG. 8 illustrates in greater detail the relative positioning of cam cut-off plate 100 relative to finger 116. According to a first embodiment, a serrated cutting edge 126 is provided on a terminating end of finger 116 configured for engagement with a complementary serrated cutting edge 128 provided on the topmost portion of stationary base edge 120 of guide plate 96. Cam cut-off plate 100 includes a clip severing device in the form of a recess 130 into which finger 116 is received prior to a severing operation. As cam cut-off plate 100 is raised, a beveled surface 162 on plate 160 is configured to bias finger 116 toward and over stationary base edge 120, causing scissoring between edges 126 and 128 and severing of a clip therebetween. By downwardly pivoting plate 100 after a scissoring operation, a new clip can then be downwardly fed for severing via a subsequent severing operation. An alternative, second embodiment is shown and described with reference to FIGS. 41-47, wherein straight cutting edges replace the serrated cutting edges on finger 116 and base 120 of plates 98 and 96, respectively. Such alternative construction is substituted for the first embodiment severing device on bag closing device 18; namely, strip guide assembly 94 (see FIG. 2) is replaced with the corresponding device of FIGS. 41-47.

As such, a clip separating machine 92 is provided as plate 100 is pivotally raised so as to cause engagement of beveled surface 162 with a complementary portion of finger 116 so as to cause scissoring between edges 126 and 128. Finger 116 is flexibly supported via rear clip guide plate 98. As illustrated in FIG. 8, it is understood that clip 26 is torsionally biased via clip deflecting plate 122 while loading an open neck portion of a bag into a clip 26 and while severing clip 26 from an adjacent strip of clips.

FIG. 9 illustrates in front view components of clip separating machine 92. More particularly, guide plates 96 and 98 are sandwiched together in spaced-apart relation via a clip guide entry spacer plate 132 and a clip guide exit spacer plate 134. Plates 132 and 134 are slightly thicker than individual clips 26 in strip 24 so as to provide a gap through which clips 26 can be downwardly fed. Cam cut-off plate 100 is shown in FIG. 9 in a downward resting position, prior to raising plate 100 during a severing operation. A trigger mechanism 136 is also shown in FIG. 9 which serves to trigger subsequent upward lifting of cam cut-off plate 100 so as to sever a terminal clip 26 from a strip 24 of such clips.

FIG. 10 illustrates a prior art construction for a prior art cam plate, referred to in U.S. Pat. No. 3,163,972 as a web-breaking rocker. Such cam plate 150 is pivotally raised and lowered via a rocker actuating link (not shown) to initially hold the prior art construction clip 152 relative to a strip of clips, and to fracture by bending a clip 152 from an adjacent strip of clips. Accordingly, the prior art techniques can clearly be shown in FIG. 10, and as taught in the prior art.

Figure 11:
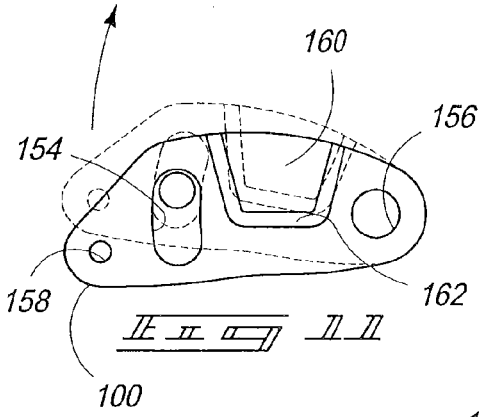
FIG. 11 is an enlarged partial view of a cam cut-off plate.

In contrast, FIG. 11 illustrates similar orientation of cam cut-off plate 100 which is raised to cause severing of a clip from a strip of clips. Plate 100 includes a recess 160 that is contiguous with a beveled contact surface 162. Plate 100 also includes a pivot hole 156 for receiving a pivotally supporting fastener and an arcuate slot 154 for receiving a clearance pin that guides pivotal motion of plate 100 between raised and lowered positions. A drive mounting hole 158 enables pivotal attachment of an attachment plate 224 (see FIG. 27) to which a drive rod raises and lowers a radial outer end of plate 100 so as to impart pivoting about pivot hole 156.

Figure 12:
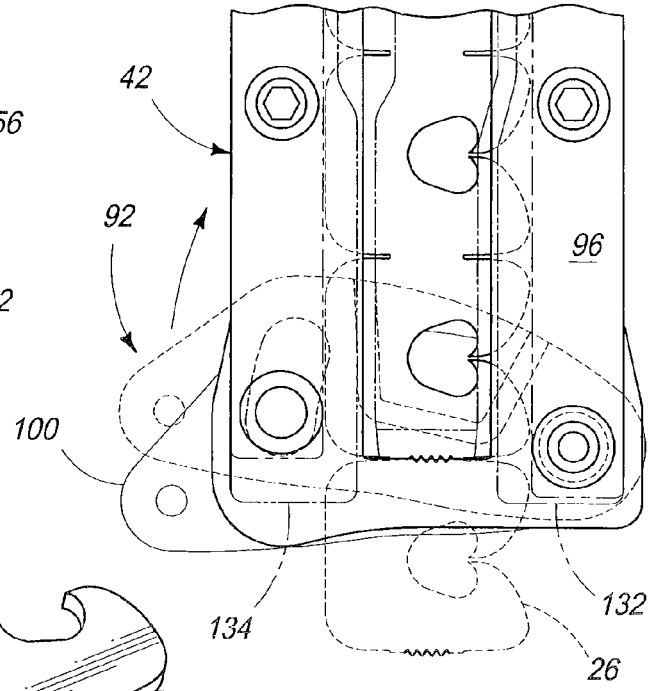
FIG. 12 is an enlarged fragmentary view of the cam cut-off plate mounted on a strip guide assembly of a severing device.

FIG. 12 further illustrates the position of plate 100 prior to a severing operation by clip separating machine 92.

Figure 13:
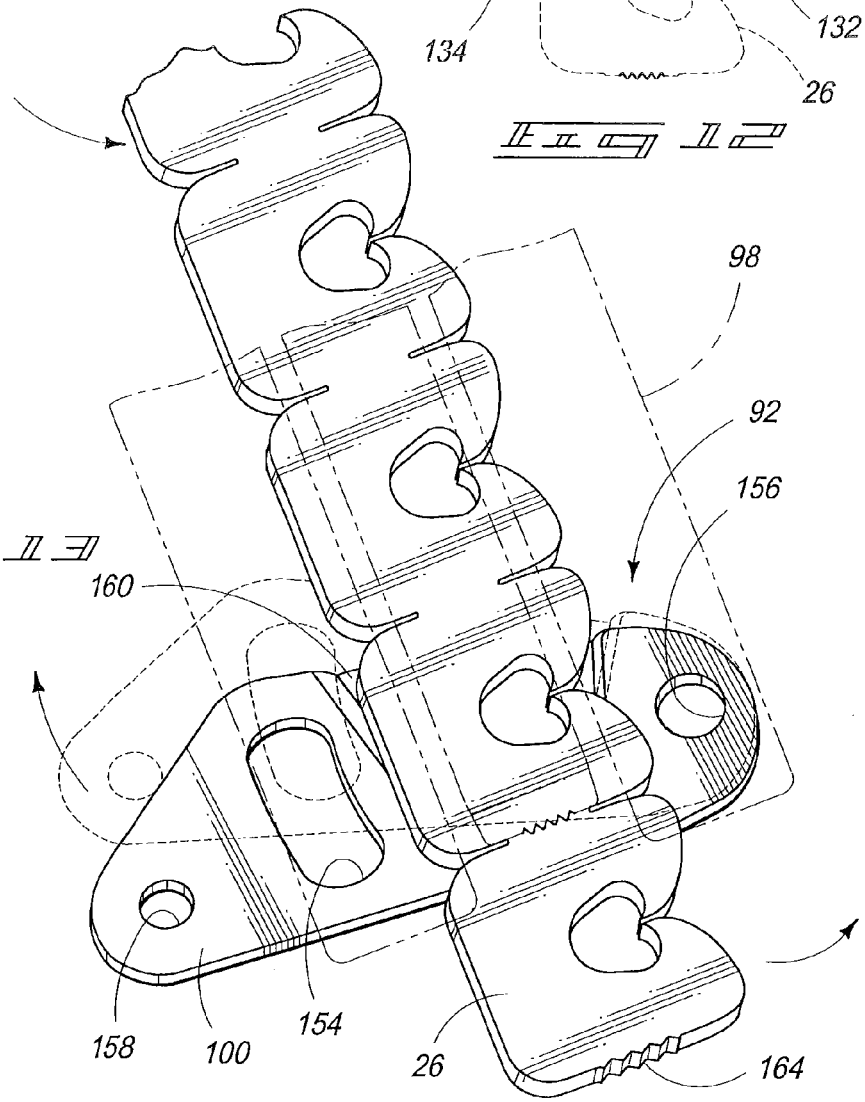
FIG. 13 is an enlarged perspective and fragmentary view of a strip of clips being cut (with portions removed) as the cam cut-off plate is rotated upwardly so as to drive a movable cutting edge (not shown) into severing relation with a stationary cutting edge (not shown) to sever a terminal clip from the strip of clips.

FIG. 13 further illustrates impartially removed assembly of cam cut-off plate 100 in relation to rear clip guide 98, prior to severing an individual clip 26 from a strip 24.

According to one construction, co-acting serrated edges are provided on clip separating machine 92 which impart a serrated edge 164 to clip 26. Alternatively, smooth cutting edges can be provided as taught in the embodiment depicted in FIGS. 41-47 which impart a smooth, straight edge to clip 26.

Figure 14:
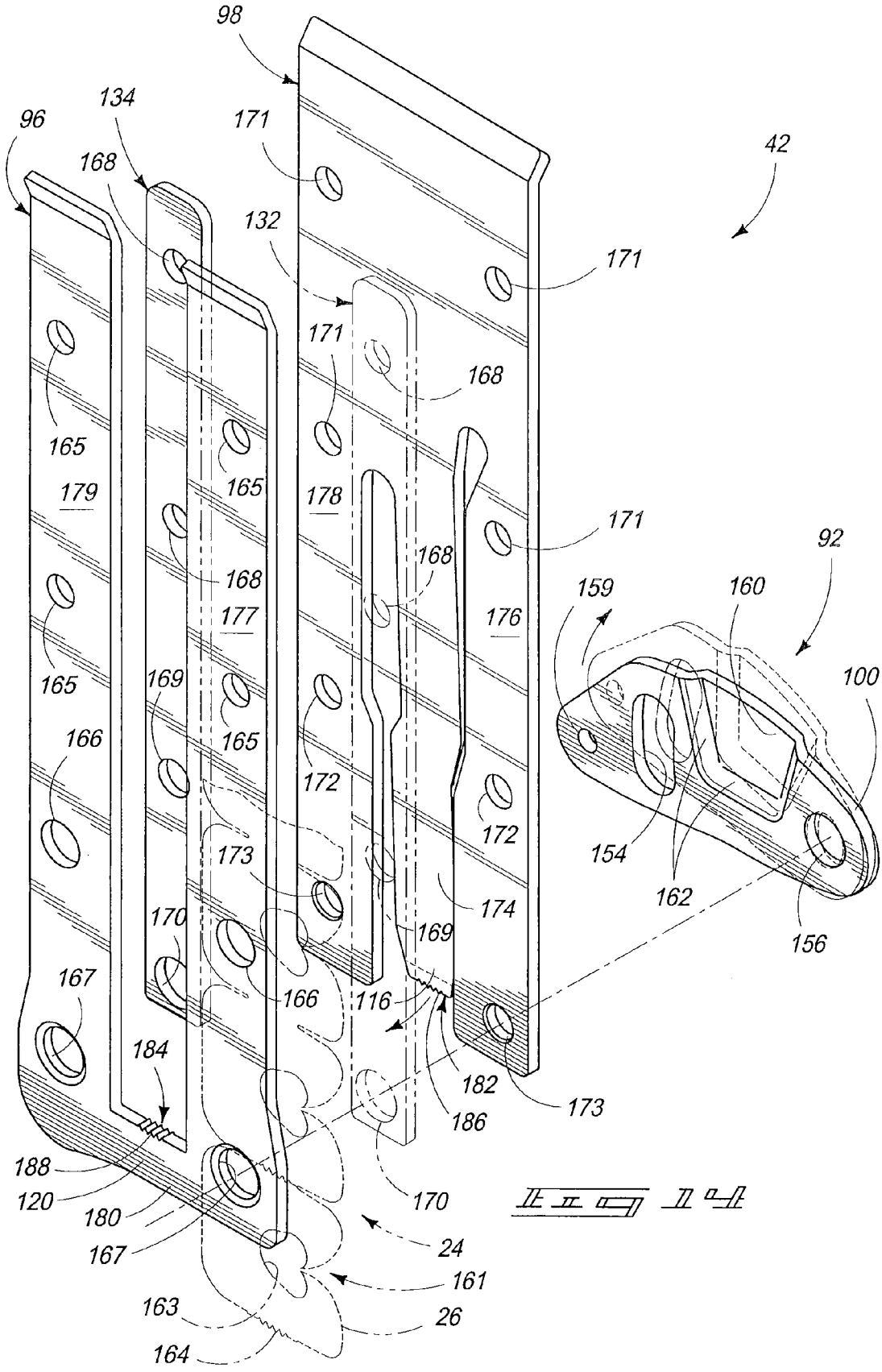
FIG. 14 is an exploded perspective view of a first embodiment severing device used in the bag closing device of FIGS. 1-9 and 11-13.

FIG. 14 illustrates in exploded unassembled perspective view front clip guide plate 96 and rear clip guide plate 98 relative to cam cut-off plate 100. According to one construction, plate 96 is constructed from 12-gauge cold-rolled steel sheet material that is case hardened to $^{15}/_{1,000}$ths of an inch. Similarly, guide plate 98 is constructed from 14-gauge steel sheet material that is case hardened to $^{15}/_{1,000}$ths of an inch.

Figure 45:
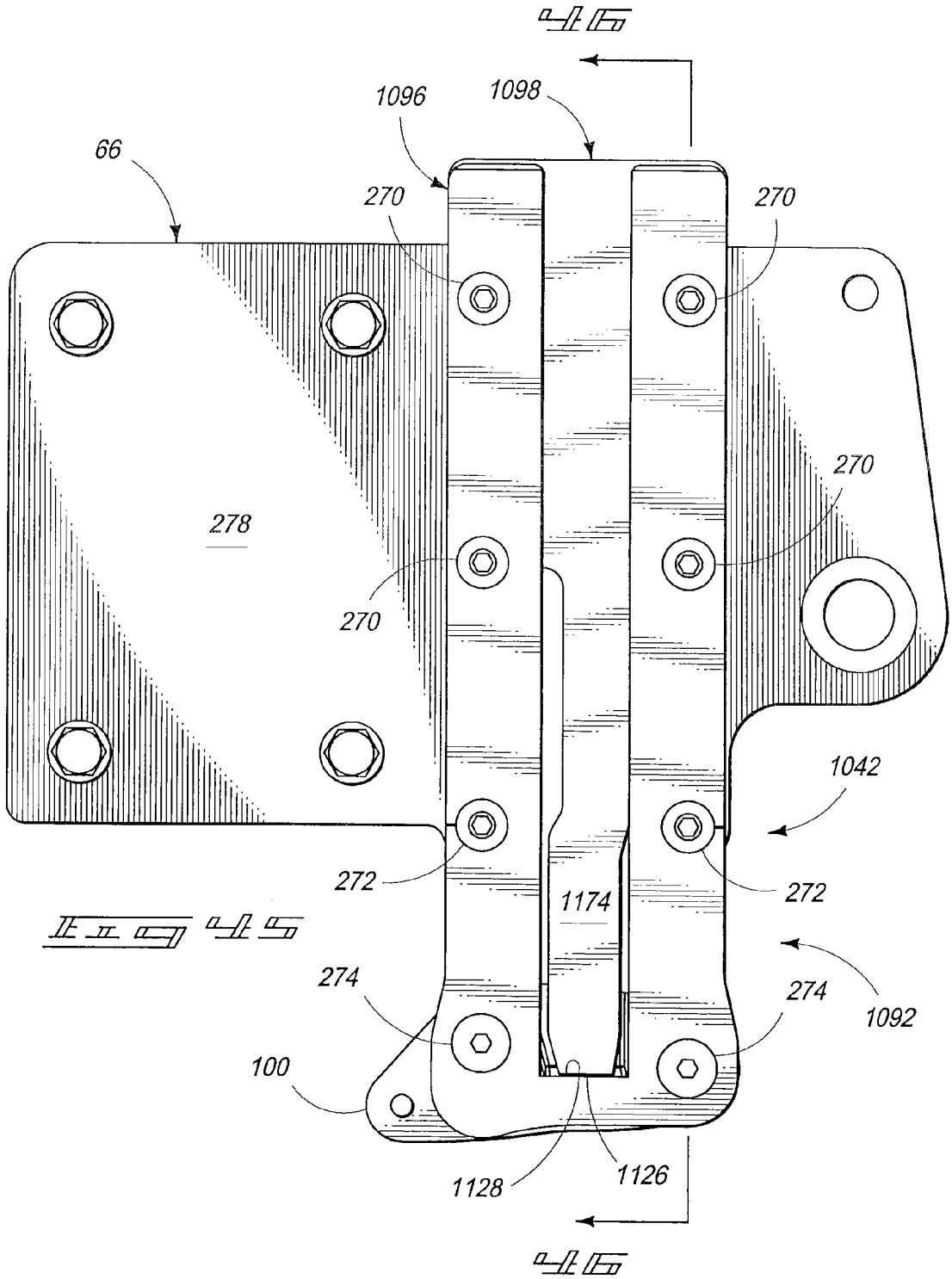
FIG. 45 illustrates in assembled front view the second embodiment clip assembly having the front clip guide plate and rear clip guide plate of FIGS. 41-44.

Front clip guide plate 96 has four identically sized cylindrical apertures 165 for receiving fasteners (such as fasteners 270 shown in the embodiment of FIG. 45). Corresponding apertures 168 and 171 are provided in spacer plates 132, 134 and rear clip guide plate 98 to enable assembly together via such fasteners onto face plate 278 of upper housing assembly 66 (see alternative embodiment in FIG. 45). Apertures 166, 169, and 172 have progressively decreasing diameters, respectively, to facilitate accurate alignment between plates 96 and 98 via fasteners 272. Identical to the alternative embodiment of FIGS. 45-47, fastener 272 accurately aligns the front plate 96 (alternatively, 1096) with the back plate 98 (alternatively, 1098) via a tapered bushing 276 that has a frustoconical outer surface. All of fasteners 270 and 272 thread into a complementary female threaded bore in face plate 278 (see FIG. 46).

Figure 27:
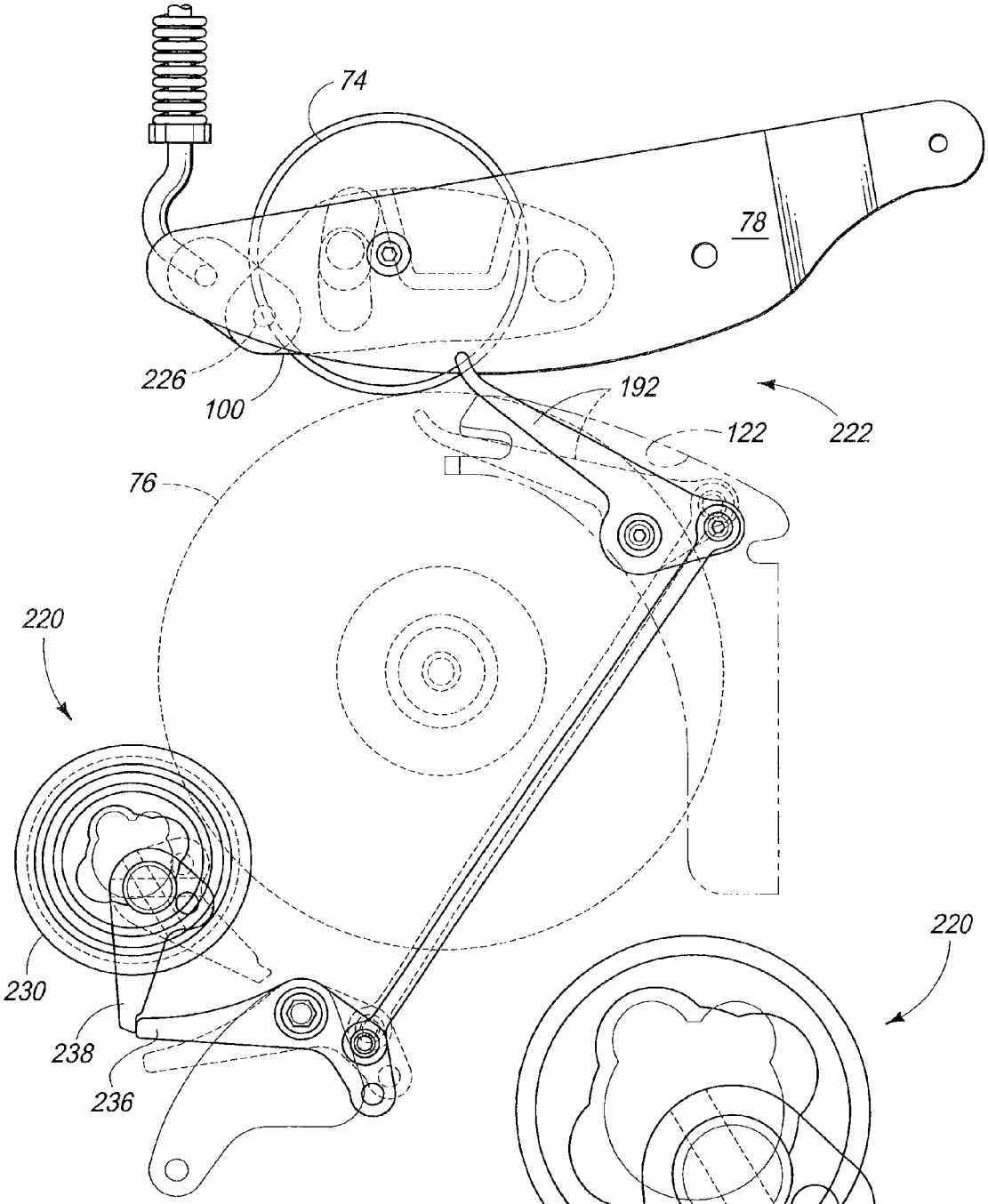
FIG. 27 is an enlarged vertical sectional view of selected subassembly components partially in phantom and illustrating a cyclical drive mechanism and a trigger mechanism configured in a ready position to apply a clip to a bag when the bag is fed into the trigger mechanism.
Figure 29:
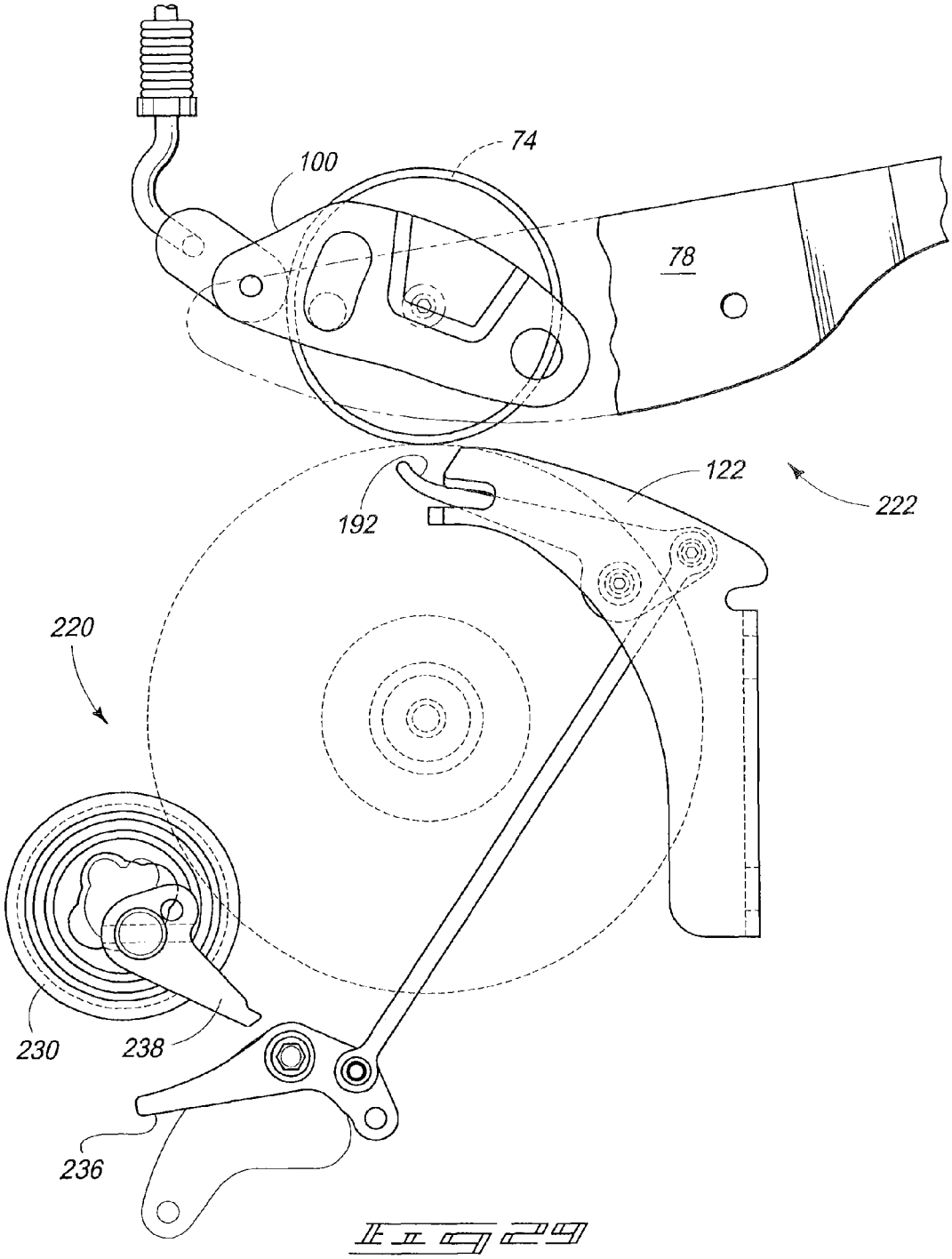
FIG. 29 is an enlarged vertical sectional view corresponding with that depicted in FIG. 27, but taken later in time after an open neck portion of a bag has activated the trigger mechanism and engaged the drive mechanism so as to raise the cam cut-off plate and sever a clip from a strip of clips there about.
Figure 46:
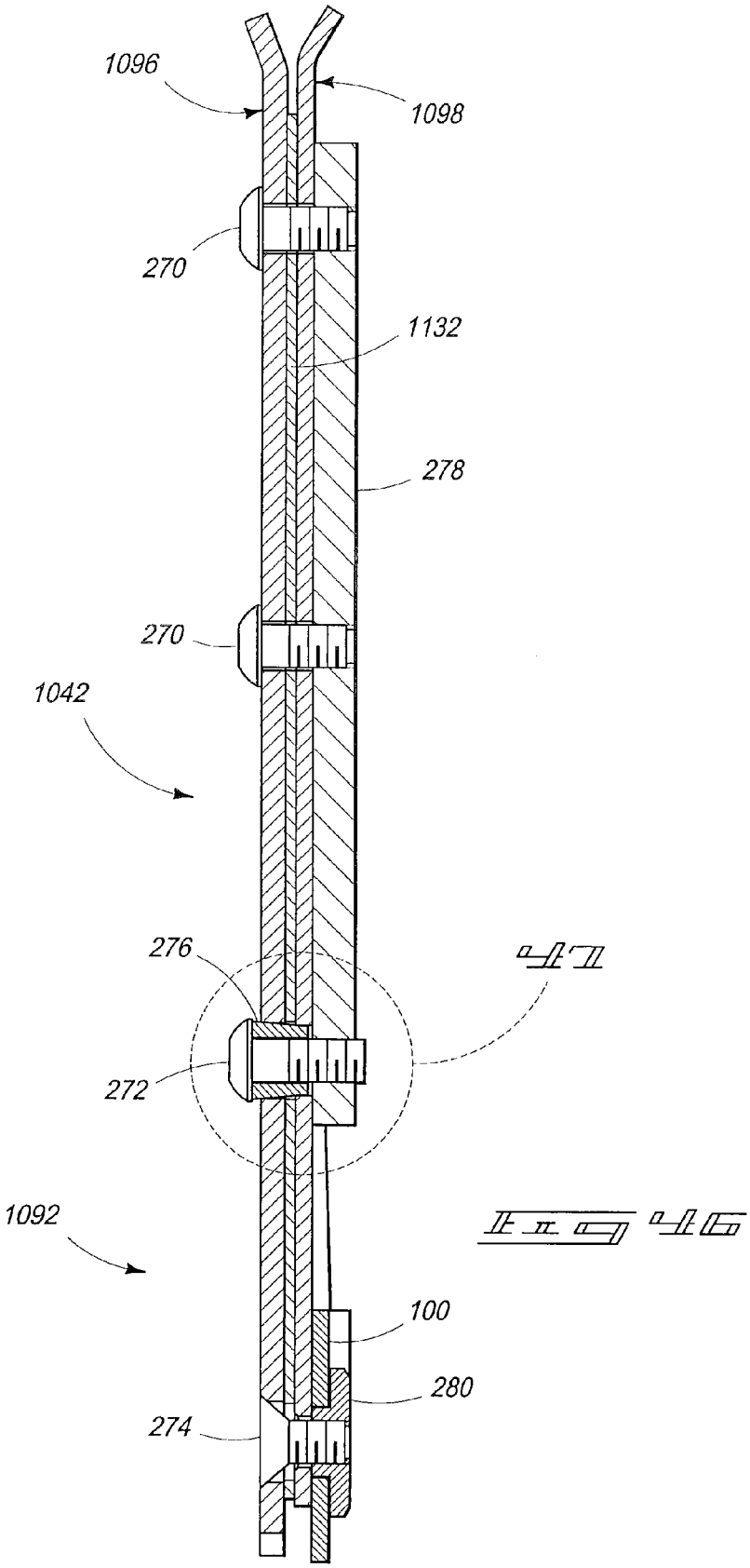
FIG. 46 illustrates a vertical sectional view of the clip assembly taken along line 46-46 of FIG. 45.

Apertures 167 are provided in front plate 96 to receive fasteners (such as fasteners 274 of FIGS. 45-46). Such fasteners 274 pass through apertures 170 and 173 in spacer plates 132, 134 and back plate 98 before passing through apertures 154 and 156 in cam cut-off plate 100. Aperture 156 provides a pivot axis for plate 100. Aperture 154 provides a pivot slot for the respective fastener 274 to enable plate 100 to pivot about aperture 156 during a clip severing operation. Bevelled contact surface 162 imparts cutting action between finger 116 and base edge 120 when plate 100 is pivoted in an upward direction. When pivoted in a downward direction, recess 160 enables finger 116 to move away from base edge 120, thereby completing and clearing the severing operation of a clip from a strip of clips. Aperture 159 of plate 100 provides an attachment point for a connection pin 226 for a lifting rod as shown in FIGS. 27 and 29 which raises and lowers to pivot plate 100 up and down. The provision of such a lifting rod is provided in the previously mentioned prior art patents and is presently understood in the art.

As shown in FIG. 14, front plate 96 has a generally U-shaped configuration with a bridge member 180 contiguously interconnecting together a pair of elongate outer members 177 and 179. Likewise, back plate 98 has a generally fork-shaped configuration with a pair elongate outer members 176 and 178 provided on either side of a medial member 174. According to the first embodiment of clip separating machine 92, bridge member 180 has base edge 120 on which a serrated cutting edge 184 is provided. A complementary serrated cutting edge 182 is provided along a terminal edge of finger 116. Each serrated edge 182 and 184 is comprised of a plurality of individual serrations 186 and 188, respectively. Upward rotation of plate 100 engages surface 162 against finger 116, driving edge 182 to co-act with edge 184 to sever a clip from a strip of clips provided therebetween. Such action occurs after an open neck-portion of a bag has been delivered through a lock slit opening 161 into a lock aperture 163 as understood in the art. According to the first embodiment, clip 26 is imparted with a serrated edge 164 from co-action of edges 182 and 184. The alternative second embodiment of FIGS. 41-47 imparts a smooth edge to such a clip.

Figure 15:
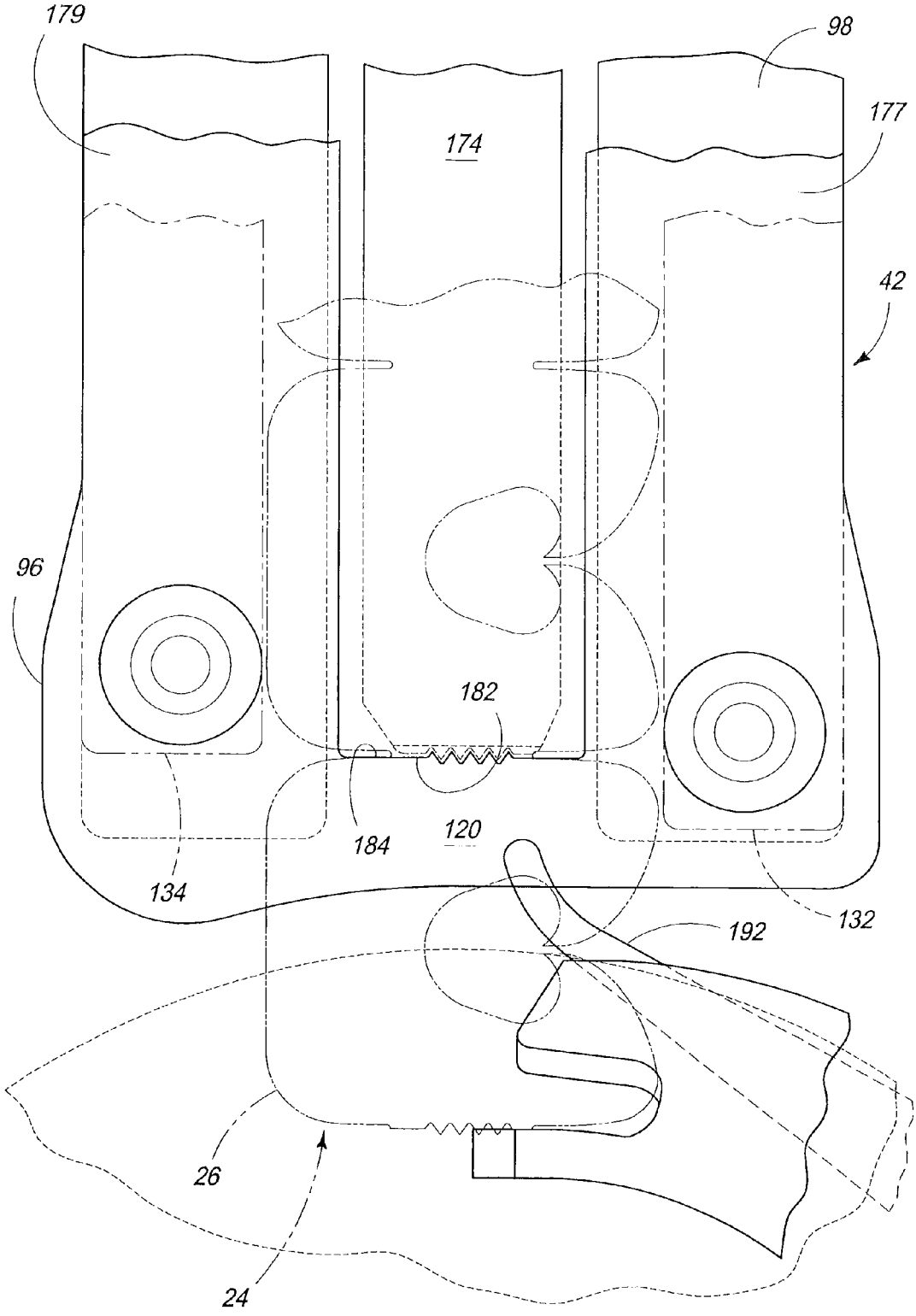
FIG. 15 is an enlarged fragmentary view of a clip being severed from a strip of clips as shown in the encircled region 15 of FIG. 9.

FIG. 15 further illustrates the configuration of clip separating machine 92.

Figures 16, 17, 18, 19, 20:
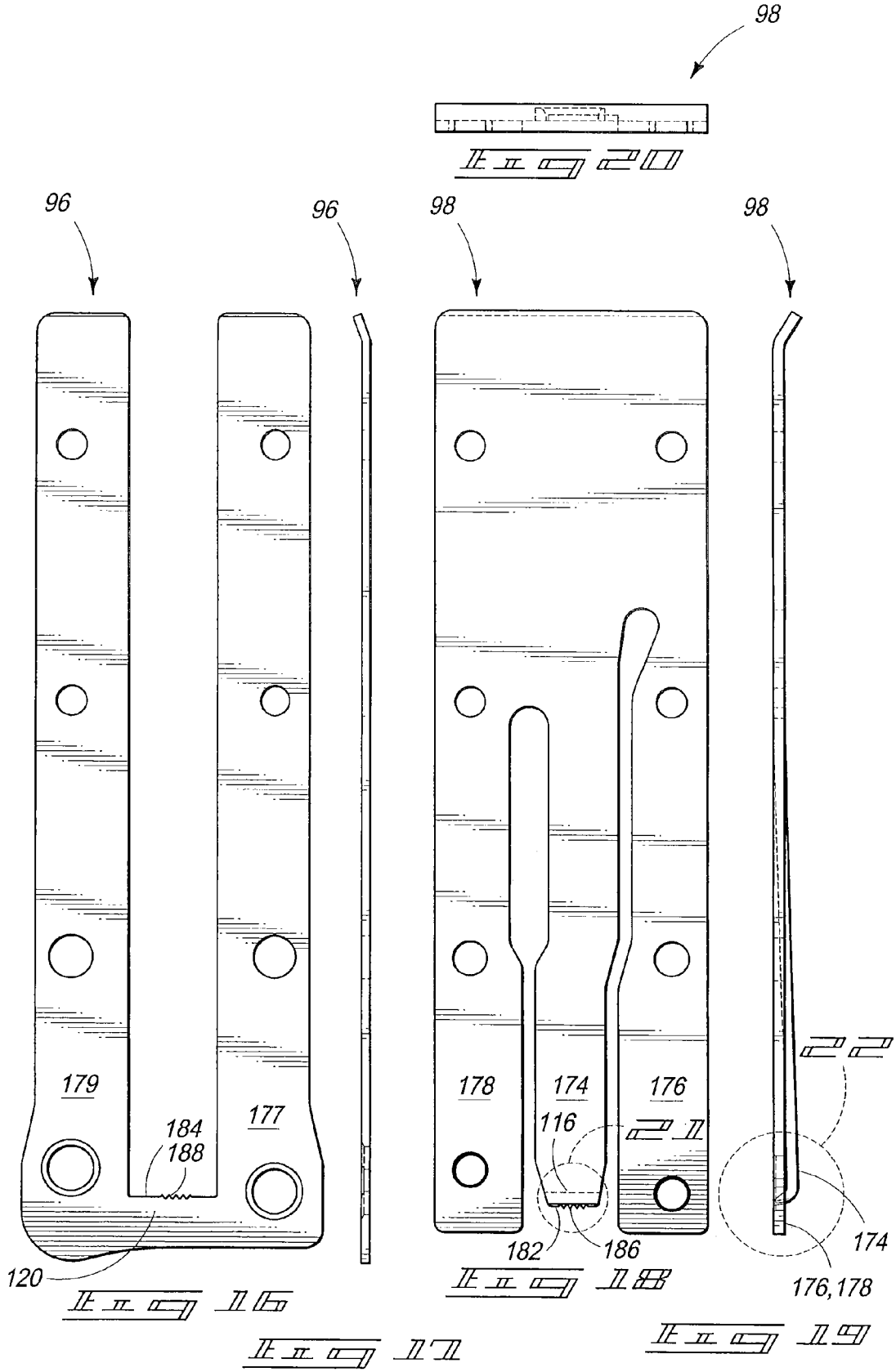
FIG. 16 is a front view of a front clip guide plate for the severing device of FIGS. 1-9 and 11-15.
FIG. 17 is a right side view of the front clip guide plate of FIG. 16.
FIG. 18 is a front view of a rear clip guide plate for the severing device of FIGS. 1-9 and 11-15.
FIG. 19 is a right side view of the rear clip guide plate of FIG. 18.
FIG. 20 is a top end view of the rear clip guide plate of FIG. 18.

FIGS. 16-22 illustrate variously the construction of front clip guide plate 96 and rear clip guide plate 98. FIG. 16 illustrates front plate 96 in front view, whereas FIG. 17 illustrates plate 96 in right side view. As shown in FIG. 16, plate 96 includes serrated cutting edge 184 on which a plurality of individual serrations 188 are provided along a top edge of base edge 120. Similarly, FIG. 18 is a front view of back plate 98, whereas FIG. 19 is right side edge view of back plate 98. The provision of finger 116 is clearly shown in FIG. 18 along which serrated cutting edge 182 is provided with a plurality of individual serrations 186. Finger 174 is flexed for and aft relative to fingers 176 and 178 during a cutting or severing operation of a clip from a strip of clips.

Figure 21:
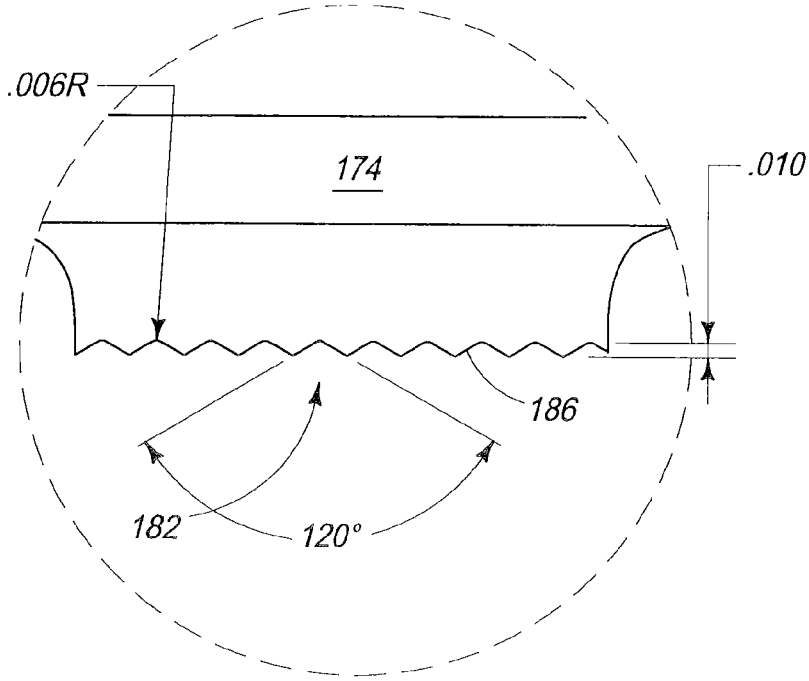
FIG. 21 is an enlarged view of the serrated cutting edge for the rear clip guide plate taken from the encircled region 21 of FIG. 20.

FIG. 21 illustrates in greater detail individual serrations 186 provided on member 174, according to one construction.

Figure 22:
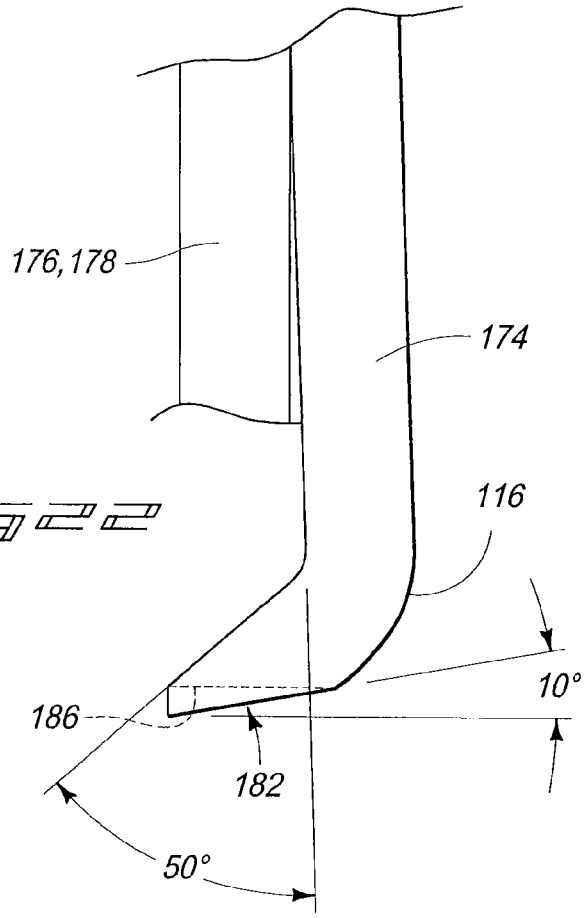
FIG. 22 is an enlarged fragmentary view of the serrated cutting edge for the rear clip guide plate taken from the encircled region 22 of FIG. 19.

FIG. 22 further illustrates a configuration of finger 116 relative to numbers 176 and 178. Serrations 186 are shown along serrated cutting edge 182.

Figure 23:
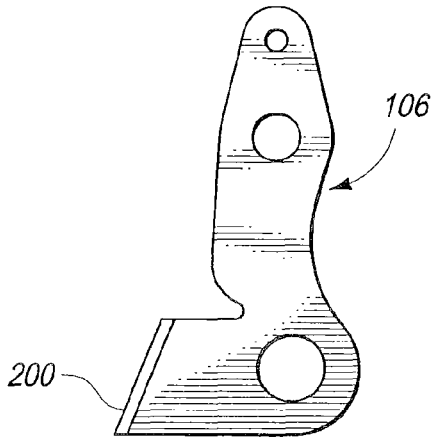
FIG. 23 is a side view of the clip strip feed finger.

FIG. 23 illustrates in side view the configuration of feed finger 106 having a drive edge 200. Drive edge 200 is configured to engage in an edge slit provided between adjacent clips in a strip of clips to drive and feed the strip of clips so as to advance one clip downwardly during an operating cycle of the clips operating machine.

Figure 24:
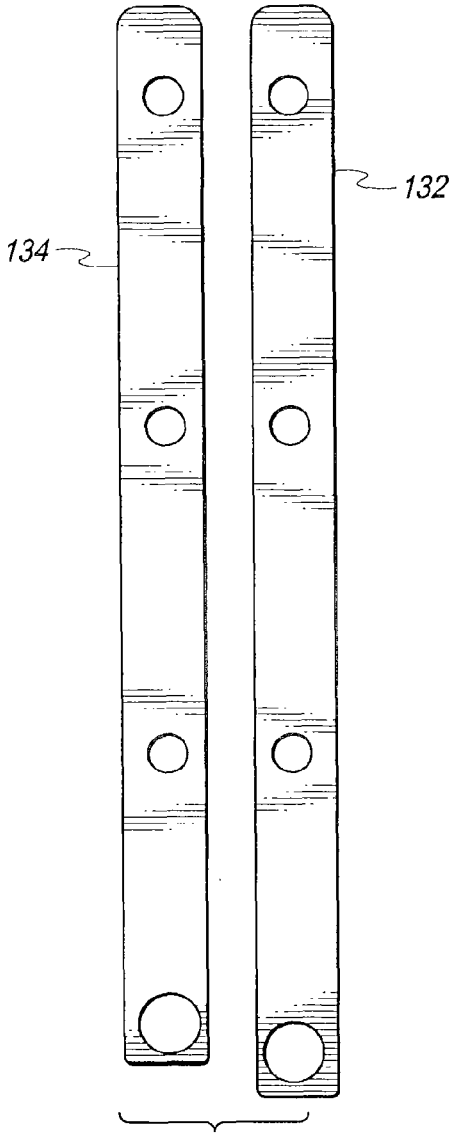
FIG. 24 is a front view of a pair of clip guide spacer entry and exit plates of the strip guide assembly.

FIG. 24 illustrates in front view the construction of spacer plates 132 and 134.

Figure 25:
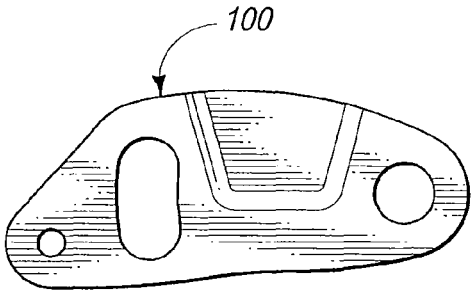
FIG. 25 is a front view of a cam cut-off plate for the strip feed mechanism of the clip severing device of FIGS. 1-9 and 11-22.
Figure 26:
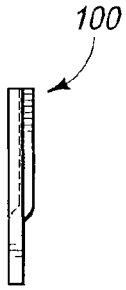
FIG. 26 is a right side view of the cam cut-off plate as shown in FIG. 25.

FIGS. 25 and 26 illustrate in front and side view the construction of cam cut-off plate 100.

FIGS. 27-40 further illustrate various operating components of the bag closing device 18 of FIGS. 1-2, as previously understood in the art, with the exception of the addition of the present clip separating machine. FIG. 27 illustrates plate 100 prior to severing a clip and prior to an open neck portion of a bag hitting a trigger finger 192 which actuates linkages via fingers 236 and 238 to activate a single revolution clutch 230 of the bag closing machine. The construction of such a clutch is already understood in the art and is utilized in the prior art bag closing machines previously described and incorporated by reference herein. Clutch 230 imparts the raising of pivot pin 226 via an actuating lot which raises plate 100 in order to initiate severing of a clip from a strip of clips.

Figure 28:
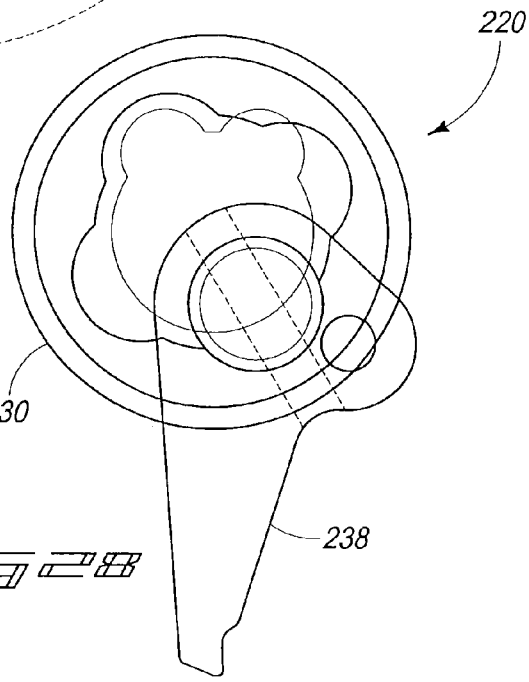
FIG. 28 is a further enlarged vertical sectional view of selected subassembly components of the drive mechanism of FIG. 27.

FIG. 28 illustrates in greater detail construction features of a single revolution clutch 230 which is provided within a clutch assembly 220.

FIG. 29 illustrates plate 100 when actuated in the raised position via the actuator rod as a result of downward depression of finger 192 and actuation of clutch 230 via release of fingers 236 and 238 which otherwise impart coaction therebetween. Accordingly, clutch 230 is actuated which eventually results in raising of finger 192, according to techniques presently understood in the art.

Figure 30:
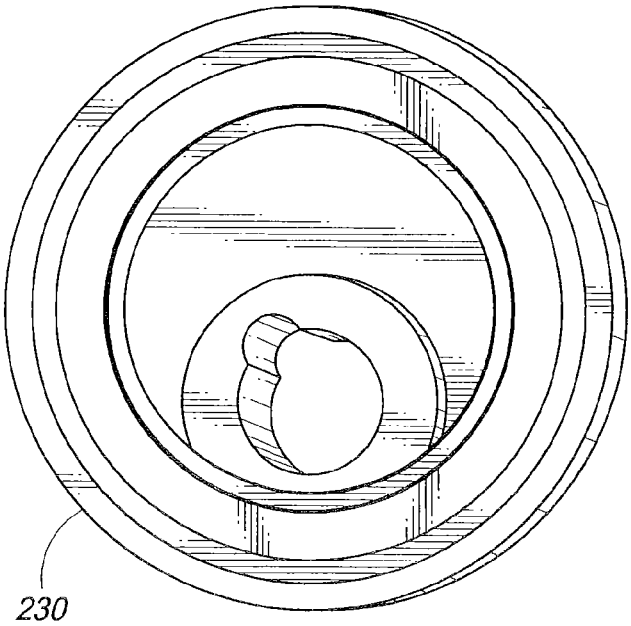
FIG. 30 is an enlarged isometric view of an eccentric bearing that connects to a lower end of an adjustable connecting rod that drives the clip strip feeder mechanism in reciprocating motion in response to input from a rotary input source via a rotary input shaft.
Figure 31:
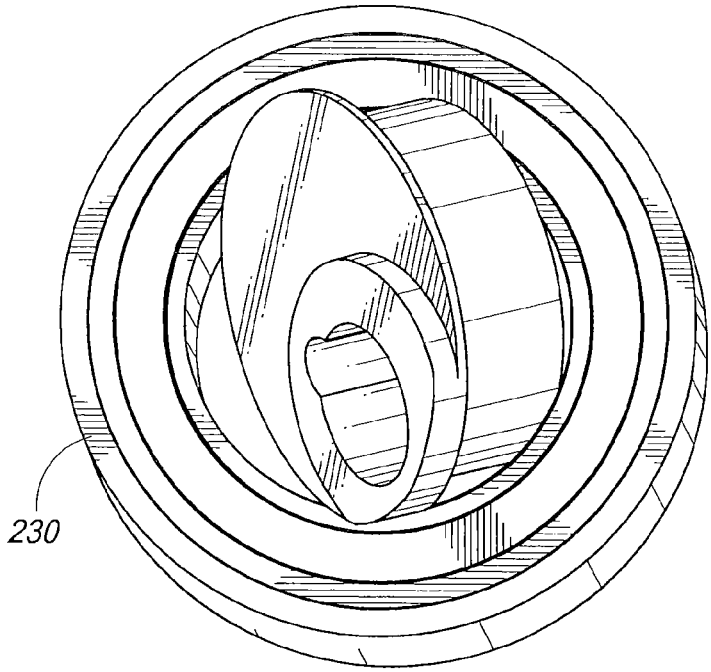
FIG. 31 illustrates the bearing of FIG. 30 in a partially disassembled state.

FIGS. 30 and 31 further illustrate the construction of clutch 230.

FIG. 32 illustrates construction of a clip deflecting plate 122 that is used to bias open a clip 26 during a bag neck loading operation. FIG. 33 further illustrates such deflection and closing or opening of clip 26 via plate 122.

Figure 34:
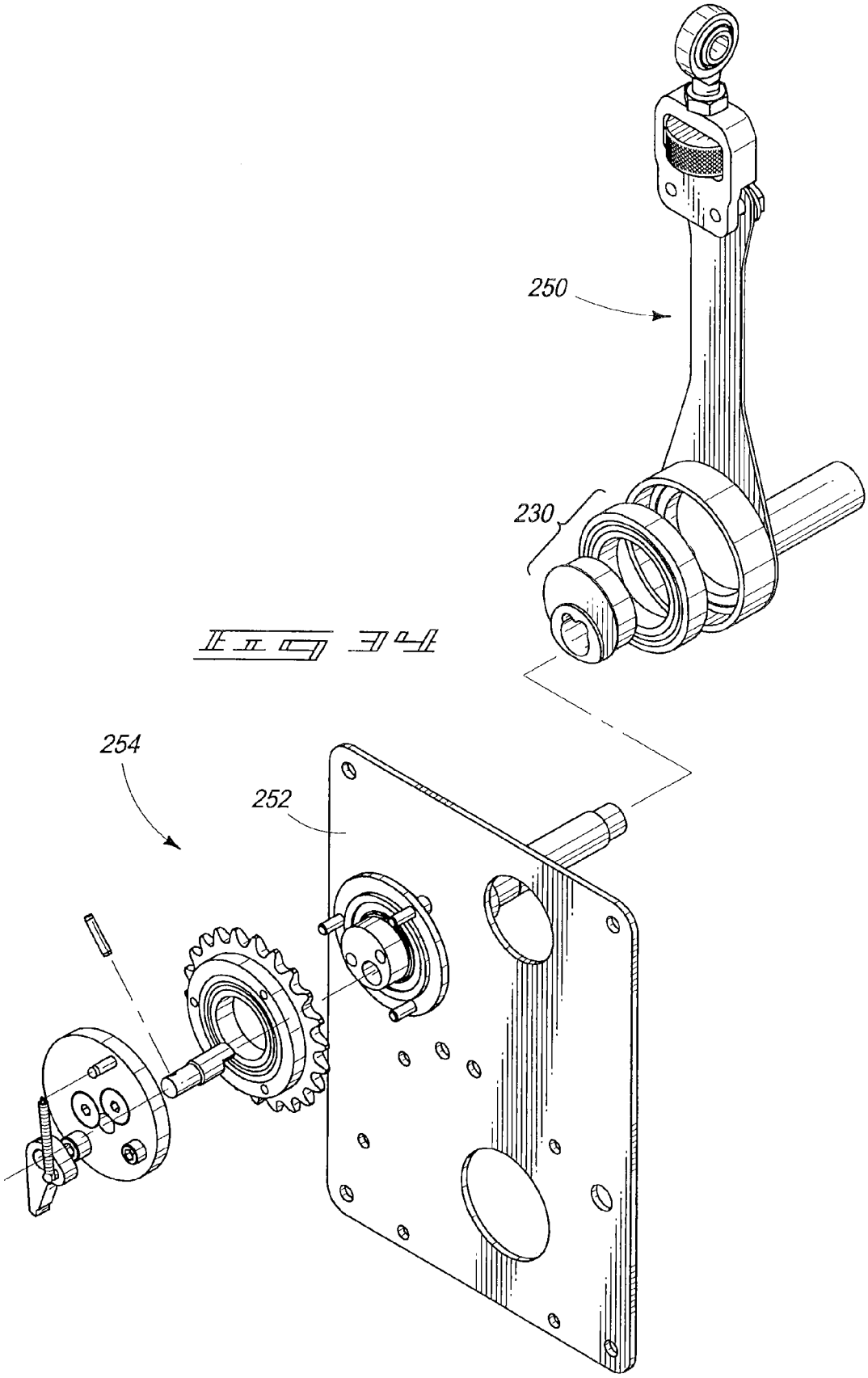
FIG. 34 is an exploded perspective view of a subassembly illustrating the connector rod assembly and eccentric bearing as configured to couple with the drive mechanism of FIG. 27.

FIG. 34 further illustrates incorporation clutch 230 into actuator arm 250 of a connector rod sub assembly in which the centered bearing is configured to couple with a drive mechanism of FIG. 27.

Figure 35:
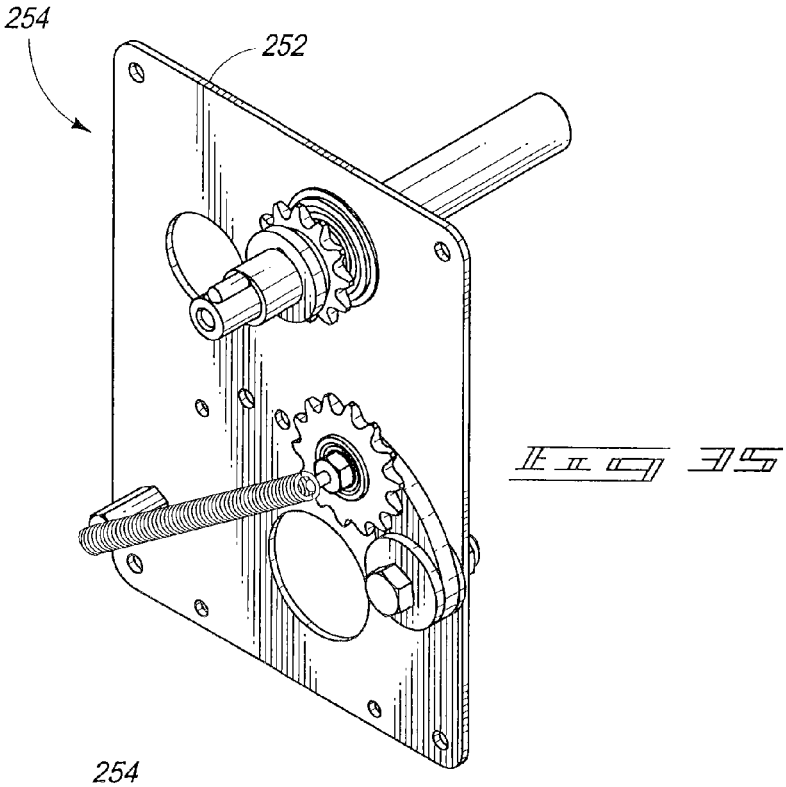
FIG. 35 illustrates in an enlarged perspective view of a subassembly of selected components of the device of FIG. 34, but taken from the back side of the mounting plate.
Figure 36:
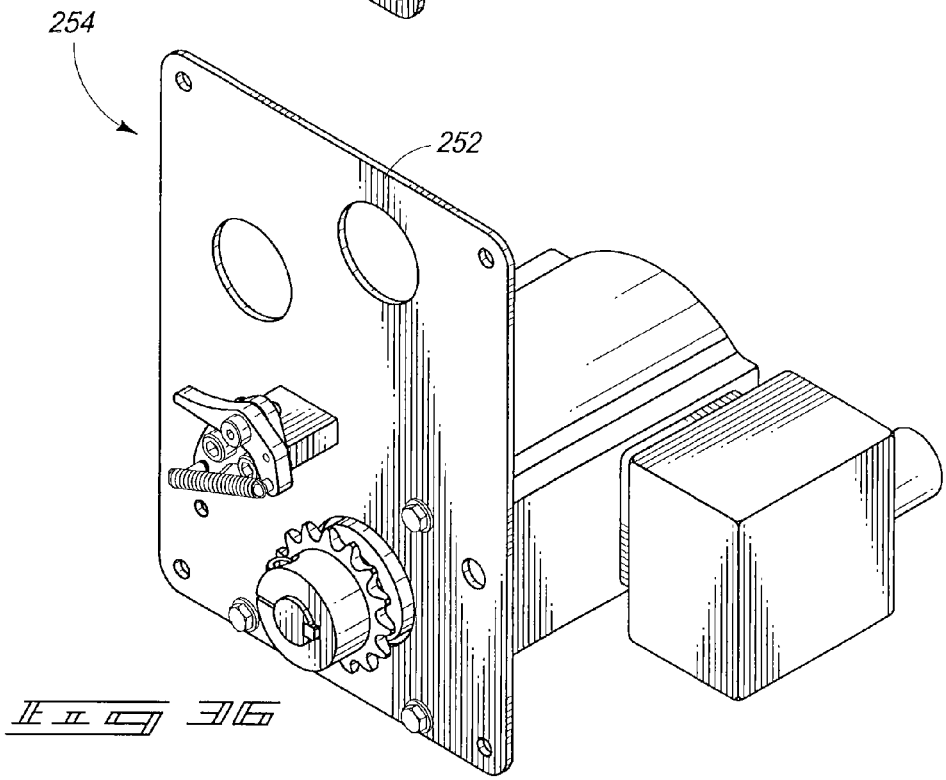
FIG. 36 illustrates further selected components affixed to the mounting plate of FIG. 35.

FIG. 35 illustrates further construction of sub assembly 254 with selected components removed. Likewise, FIG. 36 further illustrates the construction of sub assembly 254 with other selected components removed for viewing. Construction of such sub assembly is already understood in the art according to the previously mentioned prior art references, previously incorporated herein by reference.

Figure 37:
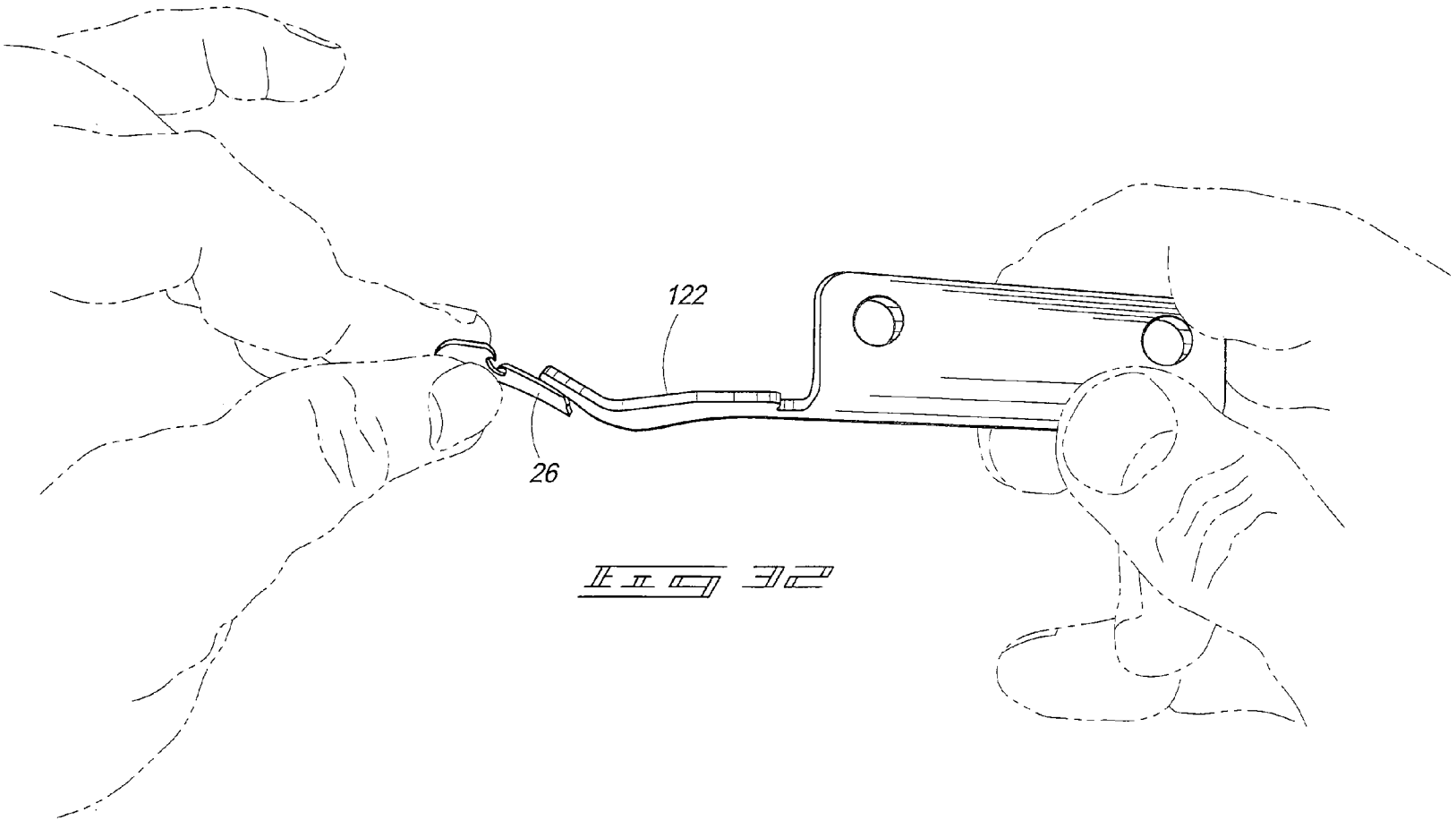
FIG. 37 illustrates internal components for the single revolution clutch of the bag closing machine.
Figure 31:
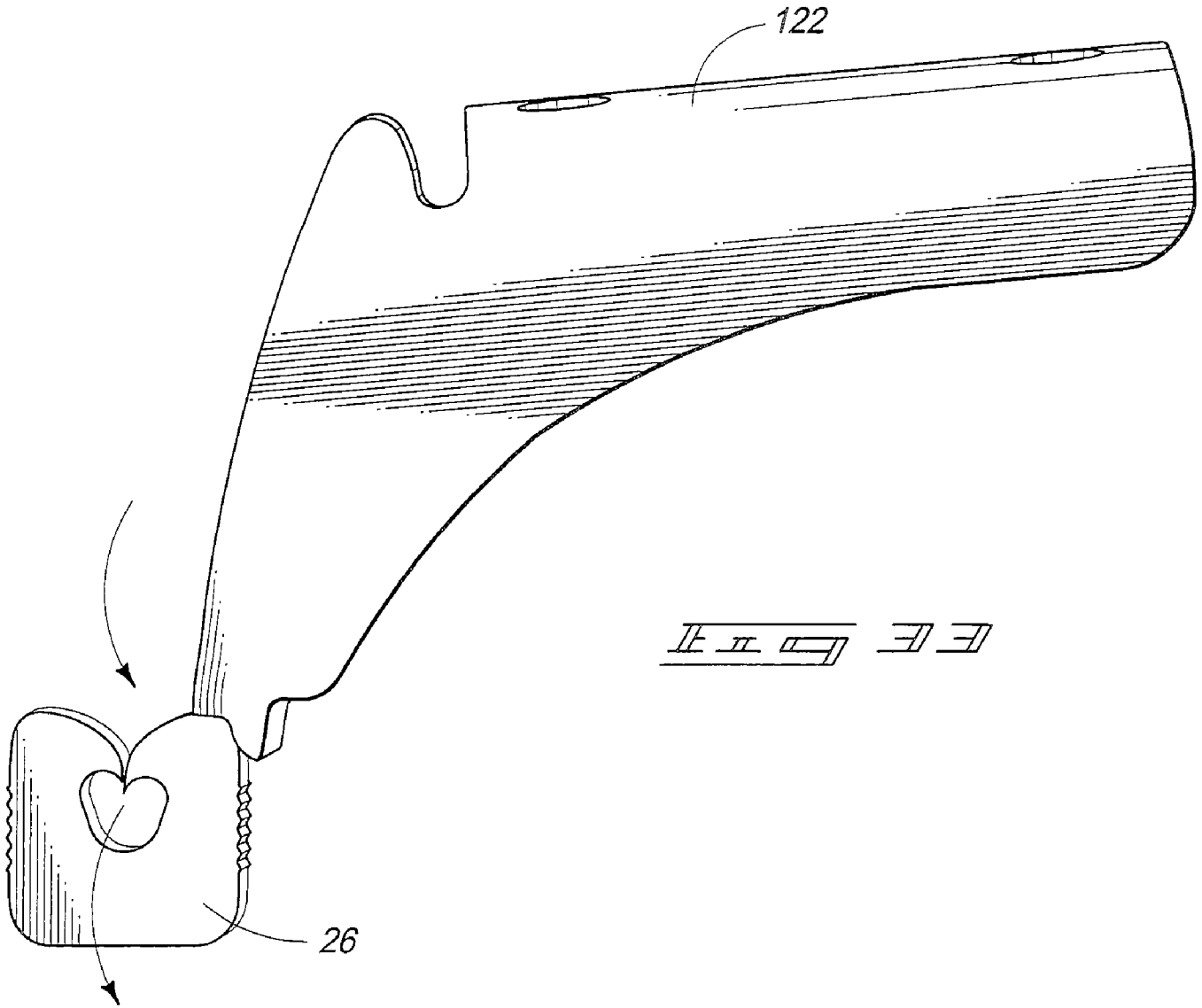
Figure 40:
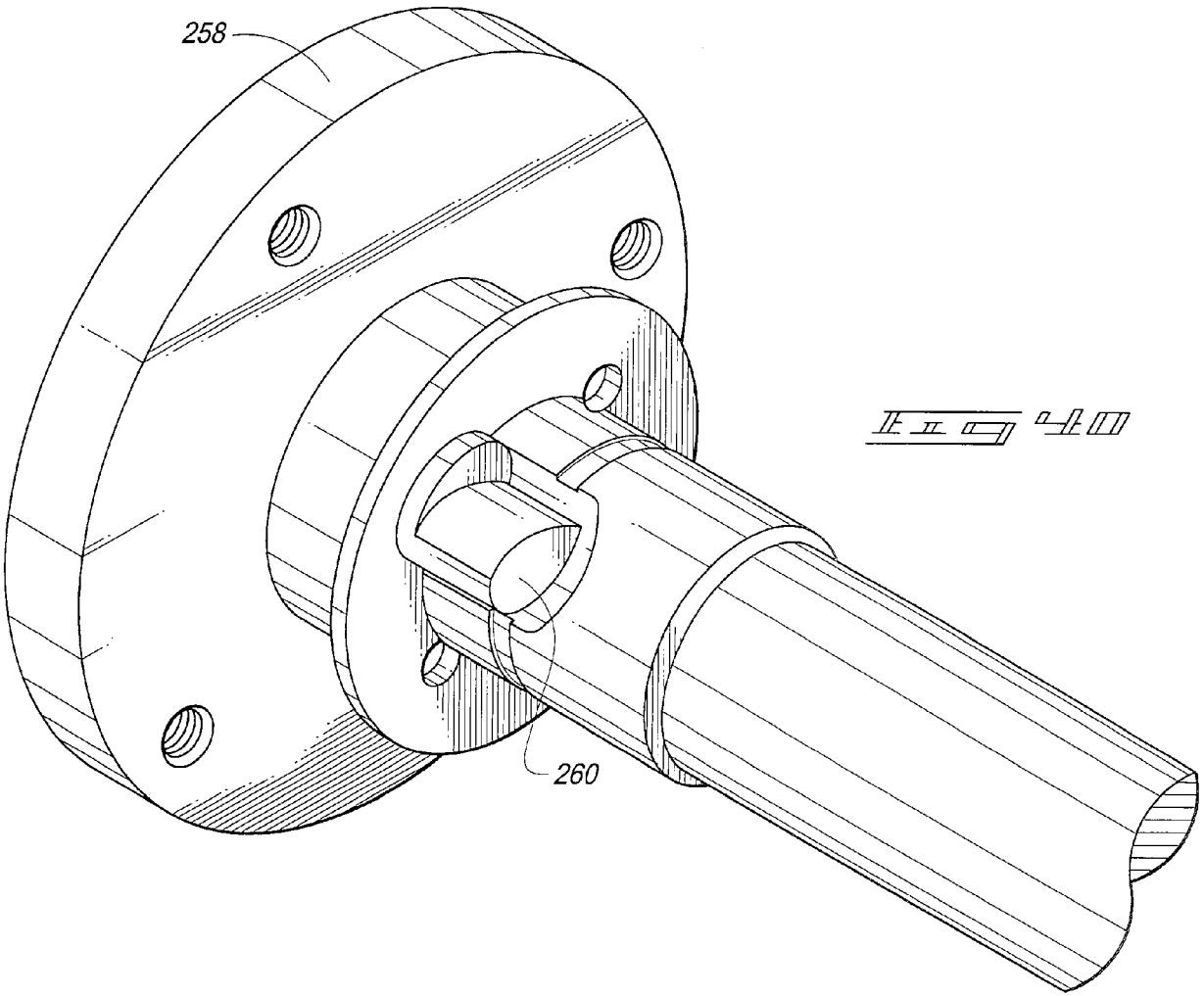
FIG. 40 illustrates positioning of the pin relative to the clutch of the clutch assembly.

FIG. 37 further illustrates a construction of a single revolution clutch 256. FIG. 38 illustrates a construction of clutch pin 260 used in such clutch and FIG. 39 illustrates a clutch component 258 that is carried within a clutch bell. FIG. 40 illustrates positioning of pin 260 relative to the clutch assembly and component 258.

Finally, FIGS. 41-47 illustrate a second embodiment construction for a clip separating machine 1092 (see FIGS.

Figures 41, 42, 43, 44:
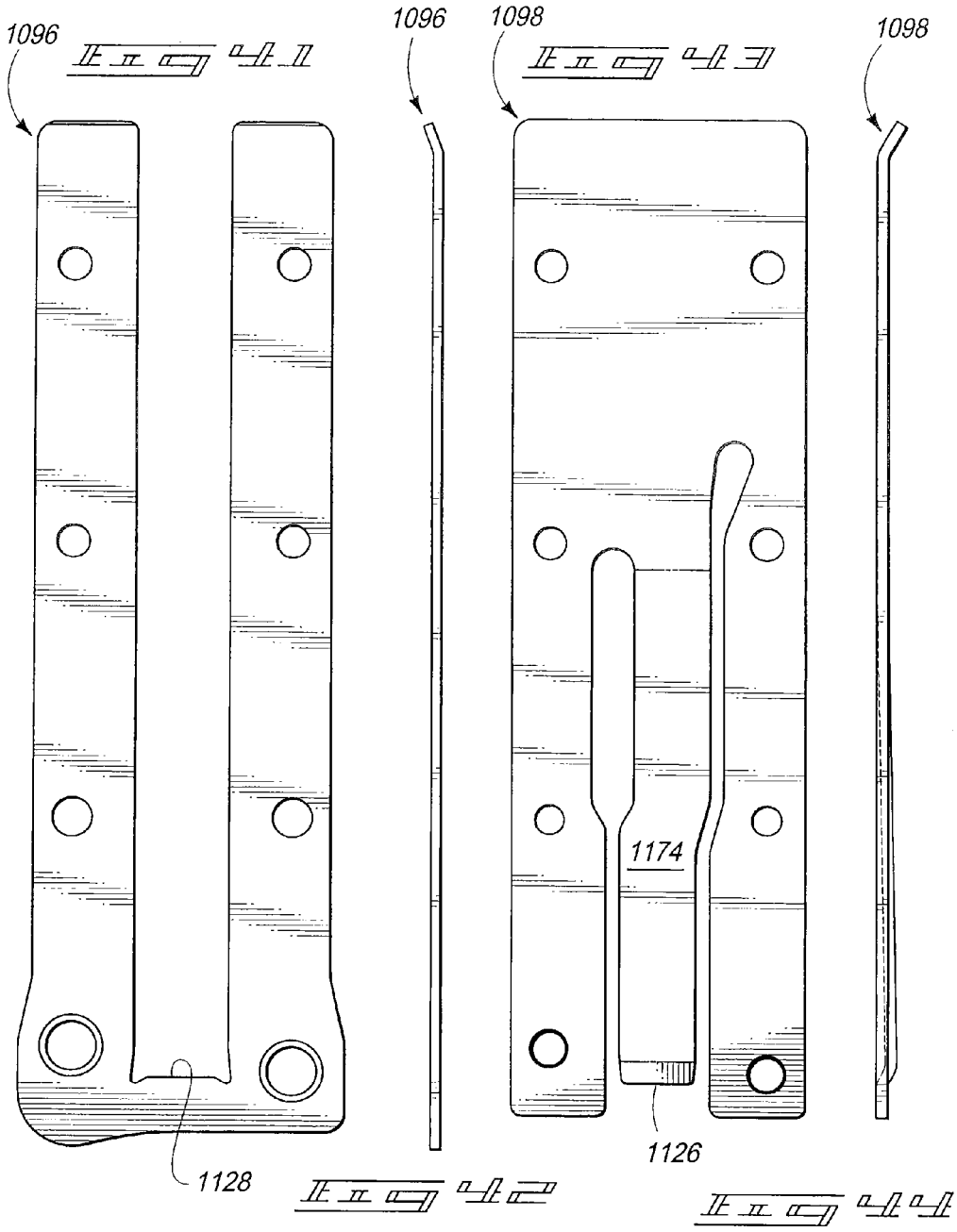
FIG. 41 illustrates in front view a front clip guide plate for a second embodiment severing device.
FIG. 42 is a right side view of the front clip guide plate of FIG. 41.
FIG. 43 illustrates in front view a rear clip guide plate for the second embodiment severing device.
FIG. 44 is a right side view of the rear clip guide plate of FIG. 43.

45-46). Such a clip separating machine includes front plate 1096 depicted in FIGS. 41 and 42. Front plate 1096 has a smooth, linear cutting edge 1128. Likewise, back plate 1098 is depicted in FIGS. 43 and 44. Finger 1174 of back plate 1098 includes a complementary smooth and linear cutting edge 1126 that coacts with cutting edge 1128 to severe a clip from a strip of clips therebetween. Finger 1174 is moved in a similar manner to finger 74 of clip separating machine 92 (in FIG. 14.)

FIG. 45 illustrates the assembled together construction for clip separating machine 1092; namely, front clip guide plate 1096 is affixed together with rear clip guide plate 1098 via spacer plates that are identical to spacer plates 132 and 134 (of FIG. 14). Plates 1096 and 1098 (as well as the spacer plates) are affixed together via fasteners 270, 272, and 274 onto face plate 278 of upper housing assembly 66. Cam cut-off plate 100 is pivotally affixed via the rightmost fastener 274 and is limited in pivotal motion via the leftmost fastener 274 so as to drive forward finger 1174 which drives edge 1126 into coacting cutting engagement with edge 1128. A strip of clips is received downwardly between plates 1096 and 1098 where they are advanced one at a time for severing via between edges 1126 and 1128. Typically, a terminal clip on a strip of clips is severed between edges 1126 and 1128. Alternatively, a group of clips can also be severed according to alternative construction and implementation.

FIG. 46 illustrates the assembled together construction of plates 1096, 1098 and the spacer plates, such as spacer plate 1132. The construction of rightmost fastener 274 is also shown in FIG. 26 in which the pivot spacer nut 280 is used to provide a pivot surface for plate 100 and further provide a retaining nut for fastener 274. A nut similar to nut 280 is provided in the slot of plate 100 to limit pivotal motion of plate 100 relative to plates 96 and 98 during a severing operation.

Figure 47:
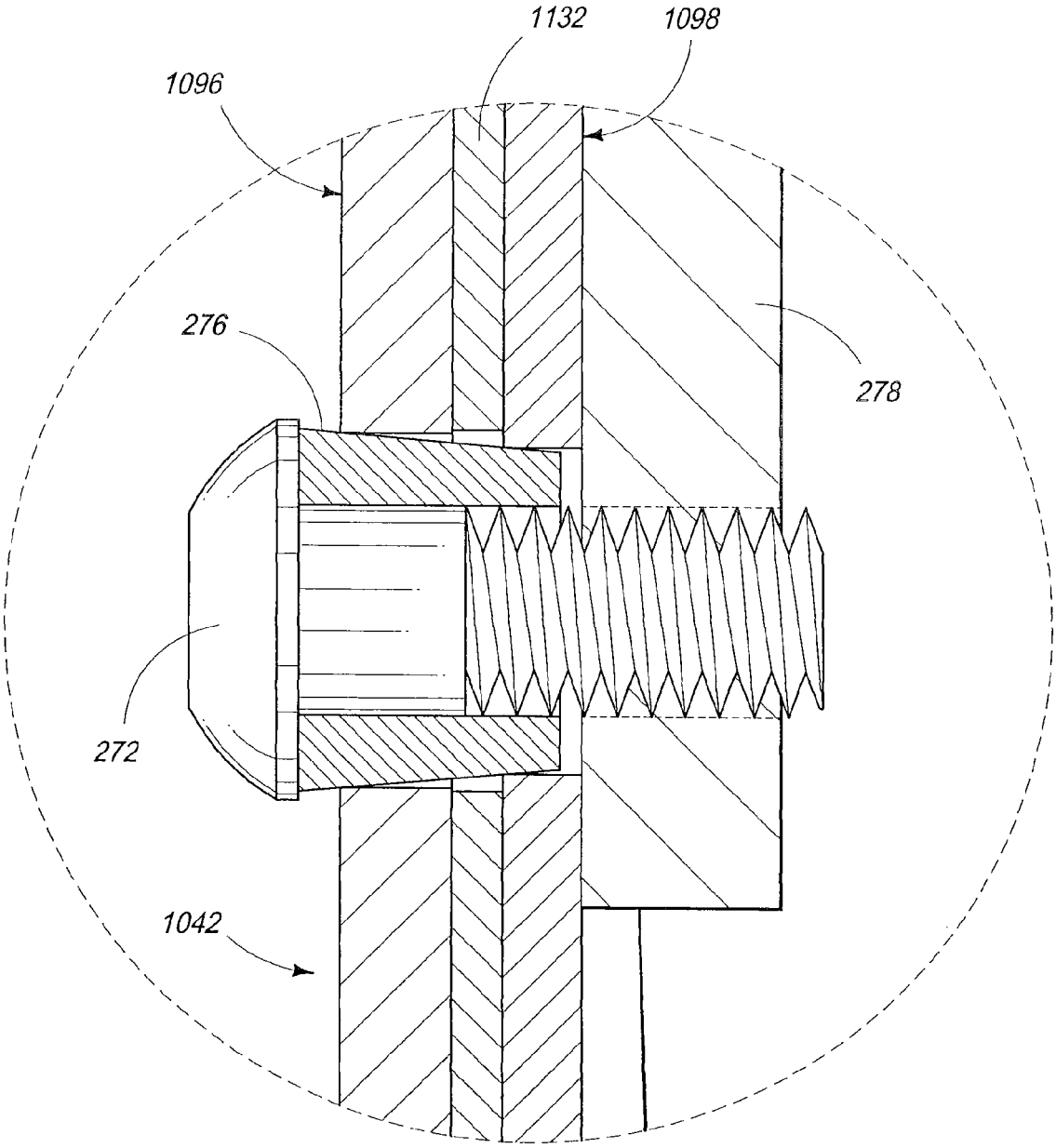
FIG. 47 illustrates a tapered bushing assembly used to accurately align the front clip guide plate relative to the rear clip guide plate assembly taken from the encircled region 47 of FIG. 46.

FIG. 47 illustrates an alignment feature that insures accurate alignment between plates 1096 and 1098 in order to guarantee accurate alignment between the cutting edges of plates 1096 and 1098. More particularly, apertures within plate 1096 are slightly larger than those in spacer plate 1132, which are slightly larger than the corresponding aperture in plate 1098. Fastener 272 receives a hardened steel tapered bushing 276 that insures concentric alignment of such apertures which further insure accurate alignment between plates 1096 and 1098. Accordingly, the cutting surfaces 1126 and 1128 (see FIG. 45) are insured to be accurately aligned upon assembly. Fastener 272 is received within a complementary threaded female bore within face plate 278.

Finally, FIGS. 41-44 illustrate an alternative embodiment for a clip separating machine comprising a front clip guide plate 1096 (see FIGS. 41-42) and a rear clip guide plate 1098 (see FIGS. 43-44). Guide plate 1098 includes a smooth cutting edge 126 whereas guide plate 1096 includes a smooth cutting edge 128. Edge 126 is provided on the terminal end of finger 1174.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A method of severing a clip from a strip of clips that are each configured to close a bag, comprising:

providing a serially arrayed strip of clips with each adjacent pair of clips joined together with a non-frangible tab;

advancing the strip of clips between a pair of coacting cutting edges to position each successive non-frangible tab between the coating cutting edges; and displacing one cutting edge toward another cutting edge to impart coaction of the cutting edges in order to sever a terminal clip from the strip of clips along the non-frangible tab.

2. The method of claim 1, further comprising providing a cam plate, and further comprising pivoting the cam plate to displace the one cutting edge toward the another cutting edge.

3. The method of claim 1, wherein one cutting edge has a serrated cutting edge and the another cutting edge has a complementary serrated cutting edge.

4. The method of claim 1, wherein the one cutting edge and the another cutting edge each have a straight cutting edge.

5. The method claim 1, after advancing the strip of clips, loading an open neck portion of a bag into the terminal clip of the strip of clips prior to displacing the one cutting edge.

6. The method of claim 1, wherein each clip of the strip of clips has a clip opening slit communicating with a clip aperture provided therein for receiving an open neck portion of a bag.

7. The method of claim 1, further comprising providing a clip deflecting plate adjacent a terminal clip of the strip of clips, and translating the clip deflecting plate into engagement with the terminal clip of the strip of clips to torsionally bias and twist open a mouth portion of the terminal clip for receiving a bag neck.

8. The method of claim 1, further comprising providing a rocker actuating link and a cam plate communicating with one of the pair of coacting cutting edges, and pivotally displacing the rocker actuating link and the cam plate to urge together the pair of coacting cutting edges.

9. A method of severing a clip from a strip of clips that are each configured to close a bag, comprising:

providing a pair of coacting cutting edges, a serially arrayed strip of clips, a guide track for guiding the strip of clips joined together by tabs for sequential axial delivery of individual clips, and an index delivery mechanism for incrementally delivering indexed successive tabs for severing between the coacting cutting edges, with each adjacent pair of clips joined together with one of the tabs;

advancing the strip of clips between the pair of coacting cutting edges to position each successive tab between the coacting cutting edges; and displacing one cutting edge toward another cutting edge to impart coaction of the cutting edges in order to sever a terminal clip from the strip of clips along the tab.

10. The method of claim 9, further comprising providing a clip deflecting plate adjacent an exit end of the guide track, and translating the clip deflecting plate into engagement with a terminal clip of the strip of clips to torsionally bias and twist open a mouth portion of the terminal clip for receiving a bag neck.

11. The method of claim 9, wherein displacing comprises driving the one cutting edge into severing engagement with the another cutting edge to a first position.

12. The method of claim 11, further comprising, after displacing, separating the one cutting edge from the another cutting edge to a second position disposed from the first position.

13. The method of claim 11, further comprising, providing a rocker actuating link and a cam plate communicating with one of the pair of coacting cutting edges, and pivotally displacing the rocker actuating link and the cam plate to urge together the pair of coacting cutting edges.

14. The method of claim 9, wherein the guide track comprises a strip guide assembly having a pair of guide plates configured to axially guide the strip of clips.

15. The method of claim 9, wherein the index delivery mechanism comprises a clip strip feed finger, and wherein advancing comprises incrementally downwardly feeding the strip of clips an individual clip length.

16. The method of claim 9, wherein the tab comprises a non-frangible tab, and displacing comprises cutting the tab between the coacting cutting edges.

* * * * *

UNITED STATES PATENT AND TRADEMARK OFFICE

CERTIFICATE OF CORRECTION

PATENT NO. : 8,261,513 B2
APPLICATION NO. : 12/572129
DATED : September 11, 2012
INVENTOR(S) : Jere F. Irwin It is certified that error appears in the above-identified patent and that said Letters Patent is hereby corrected as shown below:

In the Specification:

Column 11, line 40 – Replace “pair elongate” with --pair elongated--

In the Claims:

Column 14, line 6 – Replace “the coating cutting” with --the coacting cutting--

Signed and Sealed this
Twenty-third Day of July, 2013

Teresa Stanek Rea
*Acting Director of the United States Patent and Trademark Office*